US010658108B2

(12) United States Patent
Yamagata et al.

(10) Patent No.: US 10,658,108 B2
(45) Date of Patent: May 19, 2020

(54) METHOD FOR PRODUCING R-T-B BASED SINTERED MAGNET

(71) Applicant: HITACHI METALS, LTD., Tokyo (JP)

(72) Inventors: Ryouichi Yamagata, Mishima-gun (JP); Rintaro Ishii, Mishima-gun (JP); Futoshi Kuniyoshi, Mishima-gun (JP); Teppei Satoh, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 665 days.

(21) Appl. No.: 14/915,801

(22) PCT Filed: Sep. 1, 2014

(86) PCT No.: PCT/JP2014/072920
§ 371 (c)(1),
(2) Date: Mar. 1, 2016

(87) PCT Pub. No.: WO2015/030231
PCT Pub. Date: Mar. 5, 2015

(65) Prior Publication Data

US 2016/0284468 A1 Sep. 29, 2016

(30) Foreign Application Priority Data

Sep. 2, 2013 (JP) ..... 2013-180951
Mar. 25, 2014 (JP) ..... 2014-061623

(51) Int. Cl.
*H01F 41/02* (2006.01)
*B22F 3/24* (2006.01)
(Continued)

(52) U.S. Cl.
CPC ..... *H01F 41/0266* (2013.01); *B22F 3/24* (2013.01); *C21D 6/00* (2013.01); *C22C 33/02* (2013.01);
(Continued)

(58) Field of Classification Search
CPC ..... H01F 1/0577; B22F 2301/355; C22C 2202/02
See application file for complete search history.

(56) References Cited

U.S. PATENT DOCUMENTS 6,312,494 B1 11/2001 Tokoro et al.
2010/0233016 A1* 9/2010 Tsubokura ..... C22C 33/0278 420/83
(Continued)

FOREIGN PATENT DOCUMENTS

DE 19945942 A1 * 4/2001 ..... H01F 1/057
EP 2980808 A1 2/2016
(Continued)

OTHER PUBLICATIONS

Communication dated Mar. 31, 2017 from the European Patent Office in counterpart European application No. 14839472.9.
(Continued)

*Primary Examiner* — Colleen P Dunn
*Assistant Examiner* — Jeremy C Jones
(74) *Attorney, Agent, or Firm* — Sughrue Mion, PLLC

(57) ABSTRACT

Disclosed is a method for producing a magnet, including a step of preparing a magnet represented by the formula: uRwBxGayCuzAlqM(balance)T, where RH is 5% or less, 0.20≤x≤0.70, 0.07≤y≤0.2, 0.05≤z≤0.5, 0≤q≤0.1; when 0.40≤x≤0.70, v and w satisfy the following inequality expressions: 50w−18.5≤v≤50w−14, and −12.5w+38.75≤v≤−62.5w+86.125; and, when 0.20≤x≤0.40, v and w satisfy the following inequality expressions: 50w−
(Continued)

18.5≤v≤50w−15.5 and −12.5w+39.125≤v≤−62.5w+86.125, and x satisfy the following inequality expression: −(62.5w+v −81.625)/15+0.5≤x≤−(62.5w+v−81.625)/15+0.8; a high-temperature heat treatment step of heating the magnet to a temperature of 730° C. or higher and 1,020° C. or lower, and then cooling to 300° C. at a cooling rate of 20° C./min; and a low-temperature heat treatment step of heating the magnet to a temperature of 440° C. or higher and 550° C. or lower.

12 Claims, 4 Drawing Sheets

(51) Int. Cl.

| | |
|---|---|
| ***C22C 38/00*** | (2006.01) |
| ***C22C 33/02*** | (2006.01) |
| ***C21D 6/00*** | (2006.01) |
| ***H01F 1/057*** | (2006.01) |
| ***C22C 38/06*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |

(52) U.S. Cl.

CPC ..... *C22C 38/00* (2013.01); *C22C 38/002* (2013.01); *C22C 38/005* (2013.01); *C22C 38/06* (2013.01); *C22C 38/10* (2013.01); *C22C 38/12* (2013.01); *C22C 38/14* (2013.01); *C22C 38/16* (2013.01); *H01F 1/057*7 (2013.01); *B22F 2003/248* (2013.01); *C22C 38/001* (2013.01); *C22C 2202/02* (2013.01); *H01F 41/0293* (2013.01)

(56) References Cited

U.S. PATENT DOCUMENTS

| | | | | |
|---|---|---|---|---|
| 2011/0095855 | A1* | 4/2011 | Kuniyoshi | H01F 1/0577 335/302 |
| 2011/0262297 | A1* | 10/2011 | Ishii | B22F 1/0014 419/23 |
| 2014/0132377 | A1 | 5/2014 | Nakajima et al. | |
| 2014/0184370 | A1 | 7/2014 | Hidaka et al. | |
| 2016/0042847 | A1* | 2/2016 | Nishiuchi | C22C 38/001 335/302 |

FOREIGN PATENT DOCUMENTS

| | | | |
|---|---|---|---|
| EP | 2985768 | A1 | 2/2016 |
| JP | 2001-210508 | A | 8/2001 |
| JP | 2003-510467 | A | 3/2003 |
| JP | 2006-237168 | A | 9/2006 |
| JP | 2011-211056 | A | 10/2011 |
| JP | 2011-216678 | A | 10/2011 |
| WO | 2012/161355 | A1 | 11/2012 |
| WO | 2013/008756 | A1 | 1/2013 |

OTHER PUBLICATIONS

International Search Report of PCT/JP2014/072920 dated Dec. 9, 2014.

International Preliminary Report on Patentability issued from the International Bureau in counterpart International application No. PCT/JP2014/072920, dated Mar. 17, 2016.

* cited by examiner

METHOD FOR PRODUCING R-T-B BASED SINTERED MAGNET

CROSS REFERENCE TO RELATED APPLICATIONS

This is a National Stage of International Application No. PCT/JP2014/072920 filed Sep. 1, 2014 (claiming priority based on Japanese Patent Application No. 2013-180951 filed Sep. 2, 2013 and Japanese Patent Application No. 2014-061623 filed Mar. 25, 2014), the contents of which are incorporated herein by reference in their entirety.

TECHNICAL FIELD

The present disclosure relates to a method for producing an R-T-B based sintered magnet.

BACKGROUND ART

An R-T-B-based sintered magnet including an $R_2T_{14}B$ type compound as a main phase (R is composed of a light rare-earth element(s) RL and heavy rare-earth element(s) RH, RL is Nd and/or Pr, RH is at least one of Dy, Tb, Gd and Ho, and T is a transition metal element and inevitably includes Fe) has been known as a permanent magnet with the highest performance among permanent magnets, and has been used in various motors for hybrid cars, electric cars and home appliances.

However, in the R-T-B-based sintered magnet, coercive force $H_{cJ}$ (hereinafter sometimes simply referred to as "$H_{cJ}$") decreases at a high temperature to cause irreversible thermal demagnetization. Therefore, when used particularly in motors for hybrid cars and electric cars, there is a need to maintain high $H_{cJ}$ even at a high temperature. In addition, there is a need to obtain higher $H_{cJ}$ at room temperature so as not to cause irreversible thermal demagnetization at a high temperature.

To increase $H_{cJ}$, a large amount of heavy rare-earth elements (mainly, Dy) have hitherto been added to the R-T-B-based sintered magnet. However, there arose a problem that a residual magnetic flux density $B_r$ (hereinafter sometimes simply referred to as "$B_r$") decreases. Therefore, there has recently been employed a method in which heavy rare-earth elements are diffused from the surface into the inside of the R-T-B-based sintered magnet to thereby increase the concentration of the heavy rare-earth elements at the outer shell part of main phase crystal grains, thus obtaining high $H_{cJ}$ while suppressing a decrease in $B_r$.

Dy has problems such as unstable supply or price fluctuations because of restriction of the producing district. Therefore, there is a need to develop technology for improving $H_{cJ}$ of the R-T-B-based sintered magnet without using heavy rare-earth elements such as Dy as much as possible (by reducing the amount as much as possible).

Patent Document 1 discloses that the amount of B is decreased as compared with a conventional R-T-B-based alloy and one or more metal elements M selected from among Al, Ga, and Cu are included to form a $R_2T_{17}$ phase, and a volume fraction of a transition metal-rich phase ($R_6T_{13}M$) formed from the $R_2T_{17}$ phase as a raw material is sufficiently secured to obtain an R-T-B-based rare-earth sintered magnet having high coercive force while suppressing the content of Dy. Patent Document 1 also discloses a method for producing an R-T-B-based rare-earth sintered magnet in which a sintered body after sintering is subjected to a heat treatment at two temperatures of 800° C. and 500° C. and cooling.

Patent Document 2 specifies the effective amount of rare-earth elements and the effective amount of boron, and discloses an alloy containing Co, Cu, and Ga has higher coercive force $H_{cJ}$ at the same residual magnetization $B_r$ than a conventional alloy. Patent Document 2 also discloses a method for producing an Nd—Fe—B permanent magnet in which a sintered body after sintering is subjected to a heat treatment at 400° C. to 550° C.

PRIOR ART DOCUMENT

Patent Document

Patent Document 1: WO 2013/008756 A
Patent Document 2: JP 2003-510467 W

SUMMARY OF THE INVENTION

Problems to be Solved by the Invention

However, the R-T-B-based rare-earth sintered magnets according to Patent Documents 1 and 2 do not have high $B_r$ and high $H_{cJ}$ since the proportion of R, B, Ga and Cu therein is not optimal.

The present disclosure has been made so as to solve the above problems and an object thereof is to provide a method for producing an R-T-B based sintered magnet having high $B_r$ and high $H_{cJ}$ while suppressing the content of Dy.

Means for Solving the Problems

Aspect 1 of the present invention is directed to a method for producing an R-T-B based sintered magnet including:

a step of preparing an R-T-B based sintered magnet material, which is represented by the following formula (1):

$$uRwBxGayCuzAlqM(100\text{-}u\text{-}w\text{-}x\text{-}y\text{-}z\text{-}q)T \quad (1)$$

where

R is composed of light rare-earth element(s) RL and a heavy rare-earth element(s) RH, RL is Nd and/or Pr, RH is at least one of Dy, Tb, Gd and Ho, T is a transition metal element and includes Fe, M is Nb and/or Zr, and u, w, x, y, z, q and 100-u-w-x-y-z-q are expressed in terms of % by mass;

the RH accounts for 5% by mass or less of the R-T-B based sintered magnet, the following inequality expressions (2) to (5) being satisfied:

$$0.20 \le x \le 0.70 \quad (2)$$

$$0.07 \le y \le 0.2 \quad (3)$$

$$0.05 \le z \le 0.5 \quad (4)$$

$$0 \le q \le 0.1 \quad (5)$$

$v=u-(6\alpha+10\beta+8\gamma)$, where the amount of oxygen (% by mass) of the R-T-B based sintered magnet is $\alpha$, the amount of nitrogen (% by mass) is $\beta$, and the amount of carbon (% by mass) is $\gamma$;

when $0.40 \le x 0.70$, v and w satisfy the following inequality expressions (6) and (7):

$$50w-18.5 \le v \le 50w-14 \quad (6)$$

$$-12.5w+38.75 \le v \le -62.5w+86.125 \quad (7)$$

and, when $0.20 \leq x \leq 0.40$, v and w satisfy the following inequality expressions (8) and (9), and x satisfies the following inequality expression (10):

$$50w-18.5 \leq v \leq 50w-15.5 \quad (8)$$

$$-12.5w+39.125 \leq v \leq -62.5w+86.125 \quad (9)$$

$$-(62.5w+v-81.625)/15+0.5 \leq x \leq -(62.5w+v-81.625)/15+0.8 \quad (10);$$

a high-temperature heat treatment step of heating the R-T-B based sintered magnet material to a temperature of 730° C. or higher and 1,020° C. or lower, and then cooling to 300° C. at a cooling rate of 20° C./min; and a low-temperature heat treatment step of heating the R-T-B based sintered magnet material after the high-temperature heat treatment step to a temperature of 440° C. or higher and 550° C. or lower.

Aspect 2 of the present invention is directed to the method for producing an R-T-B based sintered magnet according to the aspect 1, wherein the temperature in the low-temperature heat treatment step is 480° C. or higher and 550° C. or lower.

Aspect 3 of the present invention is directed to the method for producing an R-T-B based sintered magnet according to the aspect 1 or 2, wherein the amount of oxygen of the R-T-B based sintered magnet obtained is 0.15% by mass or less.

Aspect 4 of the present invention is directed to the method for producing an R-T-B based sintered magnet according to the aspect 1, wherein, when $0.40 \leq x \leq 0.70$, v and w satisfy the following inequality expressions (11) and (7):

$$50w-18.5 \leq v \leq 50w-16.25 \quad (11)$$

$$-12.5w+38.75 \leq v \leq -62.5w+86.125 \quad (7)$$

and, when $0.20 \leq x < 0.40$, v and w satisfy the following inequality expressions (12) and (9), and x satisfies the following inequality expression (10):

$$50w-18.5 \leq v \leq 50w-17.0 \quad (12)$$

$$-12.5w+39.125 \leq v \leq -62.5w+86.125 \quad (9)$$

$$-(62.5w+v-81.625)/15+0.5 \leq x \leq -(62.5w+v-81.625)/15+0.8 \quad (10).$$

Aspect 5 of the present invention is directed to the method for producing an R-T-B based sintered magnet according to the aspect 4, wherein the temperature in the low-temperature heat treatment step is 480° C. or higher and 550° C. or lower.

Aspect 6 of the present invention is directed to the method for producing an R-T-B based sintered magnet according to the aspect 4 or 5, wherein the amount of oxygen of the R-T-B based sintered magnet obtained is 0.15% by mass or less.

EFFECTS OF THE INVENTION

According to the aspect of the present invention, it is possible to provide a method for producing an R-T-B based sintered magnet having high $B_r$ and high $H_{cJ}$ while suppressing the content of Dy or Tb.

MODE FOR CARRYING OUT THE INVENTION

Figure 1:
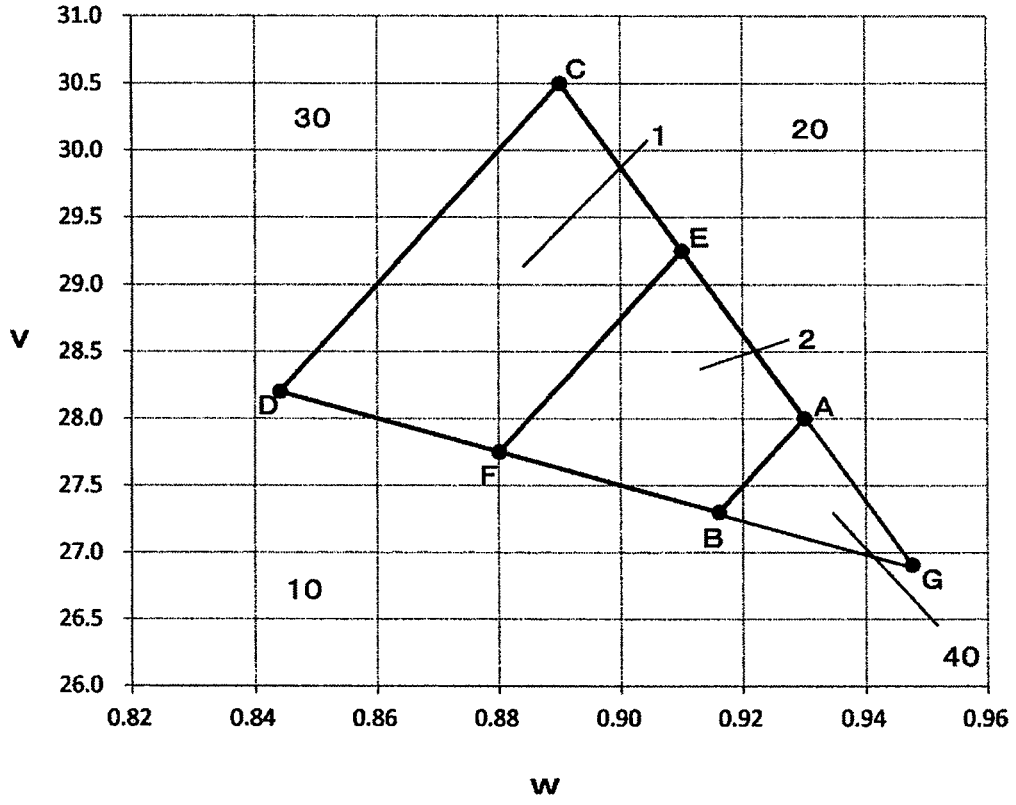
FIG. 1 is an explanatory graph showing ranges of v and w in one aspect of the present invention.

The inventors have intensively been studied so as to solve the above problems and found that an R-T-B based sintered magnet having high $B_r$ and high $H_{cJ}$ is obtained by optimizing the composition as shown in the aspect 1 or 4 of the present invention and by subjecting an R-T-B based sintered magnet material with the optimized composition to a specific heat treatment.

There are still unclear points regarding the mechanism in which an R-T-B based sintered magnet having high $B_r$ and high $H_{cJ}$ is obtained by subjecting an R-T-B based sintered magnet material with a specific composition shown in aspect 1 or 4 of the present invention to a specific heat treatment. A description will be made on the mechanism proposed by the inventors based on the findings they have had so far. It is to be noted that the description regarding the following mechanism is not intended to limit the scope of the present invention.

The R-T-B based sintered magnet enables an increase in $B_r$ by increasing an existence ratio of an $R_2T_{14}B$ type compound which is a main phase. To increase the existence ratio of the $R_2T_{14}B$ type compound, the amount of R, the amount of T, and the amount of B may be made closer to a stoichiometric ratio of the $R_2T_{14}B$ type compound. If the amount of B for formation of the $R_2T_{14}B$ type compound is less than the stoichiometric ratio, a soft magnetic $R_2T_{17}$ phase is precipitated on a grain boundary, leading to a rapid reduction in $H_{cJ}$. However, if Ga is included in the magnet composition, an R-T-Ga phase is formed in place of an $R_2T_{17}$ phase, thus enabling prevention of a reduction in $H_{cJ}$.

However, it has been found that the R-T-Ga phase also has slight magnetism and if the R-T-Ga phase excessively exists on the grain boundary in the R-T-B based sintered magnet, of the first grain boundary existing between two main phases (hereinafter sometimes referred to as a "grain boundary between two grains") and the second grain boundary existing between three or more main phases (hereinafter sometimes referred to as a "triple-point grain boundary"), particularly the grain boundary between two grains which is considered to mainly exert an influence on $H_{cJ}$, the R-T-Ga phase prevents $H_{cJ}$ from increasing. In an intensive study of the inventors, it also becomes apparent that the R-Ga phase and the R-Ga—Cu phase which are considered to have less magnetism than the R-T-Ga phase may be formed on the grain boundary between two grains, together with formation of the R-T-Ga phase. Therefore, it was supposed that $H_{cJ}$ is improved by the existence of the R-Ga phase and the R-Ga—Cu phase on the grain boundary between two grains of the R-T-B based sintered magnet. It was also supposed that there is a need to form the R-T-Ga phase so as to form the R-Ga phase and the R-Ga—Cu phase and to eliminate the $R_2T_{17}$ phase, and there is a need to reduce the formation amount so as to obtain high $H_{cJ}$. It was also supposed that $H_{cJ}$ can be further improved if formation of the R-T-Ga phase can be suppressed as small as possible while forming the R-Ga phase and the R-Ga—Cu phase on the grain boundary between two grains.

To reduce the formation amount of the R-T-Ga phase in the R-T-B based sintered magnet, there is a need to suppress the precipitation amount of the $R_2T_{17}$ phase by setting the amount of R and the amount of B within an appropriate range, and to set the amount of R and the amount of Ga within an optimum range corresponding to the precipitation amount of the $R_2T_{17}$ phase. However, a part of R is consumed as a result of bonding to oxygen, nitrogen and carbon in the production process of the R-T-B based sintered magnet, so that the actual amount of R used for the $R_2T_{17}$ or R-T-Ga phase varies in the production process. Therefore, it was difficult to suppress the formation amount of the $R_2T_{17}$ or R-T-Ga phase without considering the amount of R consumed as a result of bonding to oxygen, nitrogen and carbon so as to reduce the formation amount while forming the R-T-Ga phase. The results of an intensive study lead to findings that, as shown in the aspect 1 or 4, it is possible to adjust the formation amount of the $R_2T_{17}$ or R-T-Ga phase by adjusting the value (v) obtained by subtracting $6\alpha+10\beta+8\gamma$, where the amount of oxygen (% by mass) of the R-T-B based sintered magnet is $\alpha$, the amount of nitrogen (% by mass) is $\beta$, and the amount of carbon (% by mass) is $\gamma$, from the amount of R (u), and the amount of B and the amount of Ga. In other words, it is considered to reduce the formation amount while forming the R-T-Ga phase by including the amount of Ga (x), the amount of Cu (y), and the amount of Al (z), and the amount of M (q) as needed with the proportion shown in the formula (1) in the aspect 1 and 4 of the present invention, and by including the value (v) obtained by subtracting $6\alpha+10\beta+8\gamma$ from the amount of R (u) and the amount of B (w) with the proportion shown in the formulas (6) and (7) in the aspect 1 of the present invention or the formulas (11) and (7) in the aspect 4 of the present invention when the amount of Ga is 0.40% by mass or more and 0.70% by mass or less, and with the proportion shown in the formulas (8) and (9) in the aspect 1 of the present invention or the formulas (12) and (9) in the aspect 4 of the present invention after the amount Ga is set to a specific value in the formula (10) according to v and w when the amount of Ga is 0.20% by mass or more and less than 0.40% by mass.

As a result of an intensive study of the inventors, it is also considered that in an R-T-B based sintered magnet material with the specific composition, the R-T-Ga phase is formed within a range of 440° C. or higher and lower than 730° C., but from 440° C. or higher to 550° C. or lower, the formation amount of the R-T-Ga phase is suppressed, and at a temperature more than 550° C., the R-T-Ga phase is likely to be formed excessively. It is considered that the R-T-Ga phase is not formed from lower than 440° C. to 730° C. or higher. Therefore, so as to form the R-Ga phase and the R-Ga—Cu phase while suppressing formation of the R-T-Ga phase as small as possible on the grain boundary between two grains, there is a need to perform a heat treatment in which an R-T-B based sintered magnet material with the specific composition is heated to a temperature of 440° C. or higher and 550° C. or lower. However, generally in a sintering step, sintering is often performed with a compact put into a metal container (a sintering pack) so as to attempt to prevent oxidation of the compact and to perform soaking during sintering, and in this case, it is difficult to control the cooling rate after sintering. It was found that the compact is cooled relatively slowly (at a slow cooling rate) through a temperature range of lower than 730° C. and 550° C. or higher during cooling after sintering, and thus large amounts of the R-T-Ga phase is formed on the grain boundary between two grains, and formation of the R-T-Ga phase on the grain boundary between two grains cannot be suppressed as small as possible.

Then, a further intensive study revealed that higher $B_r$ and higher $H_{cJ}$ can be obtained by performing a high-temperature heat treatment step of heating an R-T-B based sintered magnet material, after sintering, to a temperature of 730° C. or higher and 1,020° C. or lower, and then cooling to 300° C. or lower at a cooling rate of 20° C./min or more (more specifically, to 300° C. at a cooling rate of 20° C./min or more), and a low-temperature heat treatment step of heating the R-T-B based sintered magnet material, after the high-temperature heat treatment step, to a temperature of 440° C. or higher and 550° C. or lower. The high-temperature heat treatment step eliminates the R-T-Ga phase on the grain boundary between two grains formed after sintering, and then cooling is performed at a rate so as not to form the eliminated R-T-Ga phase again. In the high-temperature heat treatment step, since a subject for heat treatment is the R-T-B based sintered magnet material after sintering, there is no need to use a metal container for prevention of oxidation, and a cooling rate can be controlled. It is considered that by subjecting the R-T-B based sintered magnet material after the high-temperature heat treatment step in which the R-T-Ga phase is eliminated, to the low-temperature heat treatment step, the R-Ga phase and the R-Ga—Cu phase can be formed while suppressing formation of the R-T-Ga phase on the grain boundary between two grains as small as possible.

In technique disclosed in Patent Document 1, since the amount of oxygen, the amount of nitrogen and the amount of carbon are not taken into consideration with respect to the amount of R, it is difficult to suppress the formation amount of the $R_2T_{17}$ or R-T-Ga phase. Technique disclosed in Patent Document 1 is to improve $H_{cJ}$ by promoting formation of the R-T-Ga phase, and there is not a technical idea for suppressing the formation amount of the R-T-Ga phase. Therefore, R, B, Ga, Cu and Al are not included with an optimal proportion that can form the R-Ga—Cu phase while suppressing the formation amount of the R-T-Ga phase, thus failing to obtain high $B_r$ and high $H_{cJ}$ in Patent Document 1. In technique disclosed in Patent Document 2, values of the amount of oxygen, the amount of nitrogen and the amount of carbon are takin into consideration, but with respect to Ga, $H_{cJ}$ is improved by forming a Ga-including phase (which is considered to correspond to the R-T-Ga phase of the present application) while suppressing formation of the $R_2T_{17}$ phase, and thus there is not a technical idea for suppressing the formation amount of the R-T-Ga phase, like Patent Document 1. In neither Patent Document 1 nor 2, there is not a technical idea for forming the R-Ga phase and the R-Ga—Cu phase while suppressing formation of the R-T-Ga phase on the grain boundary between two grains as small as possible. Therefore, a specific heat treatment step of eliminating the R-T-Ga phase on the grain boundary between two grains formed after sintering and of performing cooling at a rate so as not to form the eliminated R-T-Ga phase again, like the present invention, is not performed, thus failing to obtain higher $B_r$ and higher $H_{cJ}$.

Herein, an R-T-B based sintered magnet before the high-temperature heat treatment step is referred to as an "R-T-B based sintered magnet material" an R-T-B based sintered magnet after the high-temperature heat treatment step and before the low-temperature heat treatment is referred to as an "R-T-B based sintered magnet material after the high-temperature heat treatment step", and an R-T-B based sintered magnet after the low-temperature heat treatment step is referred to as an "R-T-B based sintered magnet."

[Step of Preparing R-T-B Based Sintered Magnet Material]

In a step of preparing an R-T-B based sintered magnet material, first, metals or alloys of the respective elements are prepared so as to obtain a composition mentioned in detail below of the R-T-B based sintered magnet material, and a flaky raw material alloy is produced from them using a strip casting method. Then, an alloy powder is produced from the flaky raw material alloy, and the R-T-B based sintered magnet material is prepared by compacting and sintering the alloy powder. Producing, compacting and sintering an alloy powder are performed as follows as an example. The flaky raw material alloy thus obtained is subjected to hydrogen grinding to obtain a coarsely pulverized powder having a size of 1.0 mm or less. Next, the coarsely pulverized powder is finely pulverized by a jet mill to obtain a finely pulverized powder (alloy powder) having a grain size D50 (value obtained by measurement by a laser diffraction method using an air flow dispersion method (median size on a volume basis)) of 3 to 7 μm. A kind of an alloy powder (single alloy powder) may be used as an alloy powder. A so-called two-alloy method of obtaining an alloy powder (mixed alloy powder) by mixing two or more kinds of alloy powders may be used to obtain an alloy powder with the composition of the present invention using the known method. A known lubricant may be used as a pulverization assistant in a coarsely pulverized powder before jet mill pulverization, or an alloy powder during and after jet mill pulverization. Using the alloy powder thus obtained, compacting under a magnetic field is performed to obtain a compact. The compacting under a magnetic field may be performed using any known methods of compacting under a magnetic field including a dry compacting method in which a dry alloy powder is loaded in a cavity of a mold and then compacted, and a wet compacting method in which a slurry (containing the alloy powder dispersed therein) is injected in a cavity of a mold and then compacted while discharging a dispersion medium of the slurry. The compact is sintered to obtain an R-T-B based sintered magnet material. A known method can be used to sinter the compact. To prevent oxidation from occurring due to an atmosphere during sintering, sintering is preferably performed in a vacuum atmosphere or an atmospheric gas. It is preferable to use, as the atmospheric gas, an inert gas such as helium or argon.

A composition of the R-T-B based sintered magnet material according to one aspect of the present invention is represented by the formula:

$$uRwBxGayCuzAlqM(100\text{-}u\text{-}w\text{-}x\text{-}y\text{-}z\text{-}q)T \quad (1)$$

where

R is composed of light rare-earth element (s) RL and heavy rare-earth element (s) RH, RL is Nd and/or Pr, RH is at least one of Dy, Tb, Gd and Ho, T is a transition metal element and includes Fe, M is Nb and/or Zr and includes inevitable impurities, and u, w, x, y, z, q and 100-u-w-x-y-z-q are expressed in terms of % by mass;

the RH accounts for 5% by mass or less of the R-T-B based sintered magnet, the following inequality expressions (2) to (5) being satisfied:

$$0.2 \le x \le 0.70 \quad (2)$$

$$0.07 \le y \le 0.2 \quad (3)$$

$$0.05 \le z \le 0.5 \quad (4)$$

$$0 \le q \le 0.1 \quad (5)$$

$v=u-(6\alpha+10\beta+8\gamma)$, where the amount of oxygen (% by mass) of the R-T-B based sintered magnet is α, the amount of nitrogen (% by mass) is β, and the amount of carbon (% by mass) is γ;

when $0.40 \le 0.70$, v and w satisfy the following inequality expressions (6) and (7):

$$50w-18.5 \le v \le 50w-14 \quad (6)$$

$$-12.5w+38.75 \le v \le -62.5w+86.125 \quad (7)$$

and, when $0.20 \le x < 0.40$, v and w satisfy the following inequality expressions (8) and (9), and x satisfies the following inequality expression (10):

$$50w-18.5 \le v \le 50w-15.5 \quad (8)$$

$$-12.5w+39.125 \le v \le -62.5w+86.125 \quad (9)$$

$$-(62.5w+v-81.625)/15+0.5 \le x \le -(62.5w+v-81.625)/15+0.8 \quad (10).$$

Alternatively, a composition of the R-T-B based sintered magnet material according to one aspect of the present invention is represented by the formula:

$$uRwBxGayCuzAlqM(100\text{-}u\text{-}w\text{-}x\text{-}y\text{-}z\text{-}q)T \quad (1)$$

where

R is composed of light rare-earth element(s) RL and heavy rare-earth element(s) RH, RL is Nd and/or Pr, RH is at least one of Dy, Tb, Gd and Ho, T is a transition metal element and includes Fe, M is Nb and/or Zr and includes inevitable impurities, u, w, x, y, z, q and 100-u-w-x-y-z-q are expressed in terms of % by mass;

the RH accounts for 5% by mass or less of the R-T-B based sintered magnet, the following inequality expressions (2) to (5) being satisfied:

$$0.20 \le x \le 0.70 \quad (2)$$

$$0.07 \le y \le 0.2 \quad (3)$$

$$0.05 \le z \le 0.5 \quad (4)$$

$$0 \le q \le 0.1 \quad (5)$$

$v=u-(6\alpha+10\beta+8\gamma)$, where the amount of oxygen (% by mass) of the R-T-B based sintered magnet is α, the amount of nitrogen (% by mass) is β, and the amount of carbon (% by mass) is γ;

when $0.40 \le x \le 0.70$, v and w satisfy the following inequality expressions (11) and (7):

$$50w-18.5 \le v \le 50w-16.25 \quad (11)$$

$$-12.5w-38.75 \le v \le -62.5w+86.125 \quad (7)$$

when $0.20 \le x < 0.40$, v and w satisfy the following inequality expressions (12) and (9):

$$50w-18.5 \le v \le 50w-17.0 \quad (12)$$

$$-12.5w+39.125 \le v \le -62.5w+86.125 \quad (9)$$

and x satisfies the following inequality expression (10):

$$-(62.5w+v-81.625)/15+0.5 \le x \le -(62.5w+v-81.625)/15+0.8 \quad (10).$$

The R-T-B based sintered magnet material of the present invention may include inevitable impurities. Even if the sintered magnet material includes inevitable impurities included normally in a didymium alloy (Nd—Pr), electrolytic iron, ferro-boron, and the like, it is possible to exert the effect of the present invention. The sintered magnet material sometimes includes, as inevitable impurities, for example, a trace amount of La, Ce, Cr, Mn, Si, and the like.

R in the R-T-B based sintered magnet material according to one aspect of the present invention is composed of light rare-earth element(s) RL and heavy rare-earth element(s) RH, RL is Nd and/or Pr, RH is at least one of Dy, Tb, Gd and Ho, and RH accounts for 5% by mass or less of the R-T-B based sintered magnet. In the present invention, since high $B_r$ and high $H_{cJ}$ can be obtained even when using no heavy rare-earth element, the additive amount of RH can be reduced even when higher $H_{cJ}$ is required. T is a transition metal element and inevitably includes Fe. A transition metal element other than Fe includes, for example, Co. However, the amount of replacement with Co is preferably 2.5% by mass or less, and more than 10% by mass of the amount of replacement with Co is not preferable since $B_r$ decreases. Furthermore, small amounts of V, Cr, Mn, Mo, Hf, Ta, W, and the like may be included. B is boron. It has widely been known that, when an attempt is made to obtain a specific rare-earth element, unintentional other rare-earth elements are included as impurities during the process such as refining. Therefore, R in the above-mentioned sentence "R in the R-T-B based sintered magnet according to one aspect of the present invention is composed of light rare-earth element(s) RL and heavy rare-earth element(s) RH, RL is Nd and/or Pr, RH is at least one of Dy, Tb, Gd, and Ho, and RH accounts for 5% by mass or less of the R-T-B based sintered magnet" does not completely exclude the case including the rare-earth element except for Nd, Pr, Dy, Tb, Gd and Ho, and means that the rare-earth element except for Nd, Pr, Dy, Tb, Gd and Ho may also be included to the extent to be usually included as impurities.

The amount of Ga (x) is 0.20% by mass or more and 0.70% by mass or less. The ranges of v and w vary between the case where the amount of Ga is 0.40% by mass or more and 0.70% by mass or less, and the case where the amount of Ga is 0.20% by mass or more and 0.40% by mass or less. Details are mentioned below.

In one aspect of the present invention, when the amount of Ga is 0.40% by mass or more and 0.70% by mass or less, and w have the following relationship of the inequality expressions (6) and (7):

$$50w-18.5\leq v\leq 50w-14 \quad (6)$$

$$-12.5w+38.75\leq v\leq -62.5w+86.125 \quad (7).$$

The ranges of the present invention of v and w satisfying the above inequality expressions (6) and (7) are shown in FIG. 1. v in FIG. 1 is the value obtained by subtracting $6\alpha+10\beta+8\gamma$, where the amount of oxygen (% by mass) is $\alpha$, the amount of nitrogen (% by mass) is $\beta$, and the amount of carbon (% by mass) is $\gamma$, from the amount of R(u), and w is the value of the amount of B. The inequality expression (6), namely, $50w-18.5\leq v\leq 50w-14$ corresponds to the range held between a straight line including a point A and a point B (straight line connecting a point A with a point B) and a straight line including a point C and a point D (straight line connecting a point C with a point D) in FIG. 1, while the inequality expression (7), namely, $-12.5w+38.75\leq v\leq -62.5w+86.125$ corresponds to the range held between a straight line including a point D, a point F, a point B and a point G, and a straight line including a point C, a point E, a point A and a point G. The regions 1 and 2 (region surrounded by a point A, a point B, a point D and a point C) satisfying both regions are within the range according to one aspect of the present invention. High $B_r$ and high $H_{cJ}$ can be obtained by adjusting v and w within the range of the regions 1 and 2. It is considered that, regarding the region 10 (region below from a straight line including a point D, a point F, a point B and a point G in the drawing) which deviates from the range of the regions 1 and 2, the formation amount of the R-T-Ga phase decreases since v is too smaller than w, thus failing to remove the $R_2T_{17}$ phase, or leading to a reduction in the formation amount of the R-Ga phase the and R-Ga—Cu phase. Whereby, high $H_{cJ}$ cannot be obtained. Meanwhile, regarding the region 20 (region above from a straight line including a point C, a point E, a point A, and a point G in the drawing) which deviates from the range of the regions 1 and 2, the amount of Fe is relatively deficient since w is too larger than v. If the amount of Fe is deficient, R and B become excessive, thus failing to form the R-T-Ga phase, leading to formation of the $R_1Fe_4B_4$ phase. Whereby, the formation amounts of the R-Ga phase and the R-Ga—Cu phase decrease, thus failing to obtain high $H_{cJ}$. Furthermore, in the region 30 (region above from straight line including a point C and a point D) deviating from the range of the regions 1 and 2, the R-T-Ga or R-Ga phase and the R-Ga—Cu phase are formed since v is too large and also w is too small, and an existence ratio of the main phase decreases, thus failing to obtain high $B_r$. Furthermore, in the region 40 (region where the regions 1 and 2 are removed from the region surrounded by a point C, a point D, and a point G) deviating from the range of the regions 1 and 2, an existence ratio of the main phase is high, while the R-T-Ga phase is scarcely formed since the amount of R is too small and also the amount of B is too large, and the formation amounts of the R-Ga phase and the R-Ga—Cu phase decreases, thus failing to obtain high $H_{cJ}$.

If the amount of Ga (x) is 0.20% by mass or more and less than 0.40% by mass, in one aspect of the present invention, x is adjusted within the range of the following inequality expression (10) in accordance with v and w:

$$-(62.5w+v-81.625)/15+0.5\leq x\leq -(62.5w+v-81.625)/15+0.8 \quad (10).$$

By adjusting x within the range of the inequality expression (10) in accordance with v and w, it is possible to form the R-T-Ga phase minimally necessary for obtaining high magnetic properties. If x is less than the above range, $H_{cJ}$ may decrease because of too small formation amount of the R-T-Ga phase. Meanwhile, if x exceeds the above range, unnecessary Ga exists and an existence ratio of the main phase may decrease, leading to a reduction in $B_r$.

In one aspect of the present invention, when the amount of Ga is 0.20% by mass or more and less than 0.40% by mass, v and w further have the following relationship of the inequality expressions (8) and (9):

$$50w-18.5\leq v\leq 50w-15.5 \quad (8)$$

$$-12.5w+39.125\leq v\leq -62.5w+86.125 \quad (9).$$

Figure 2:
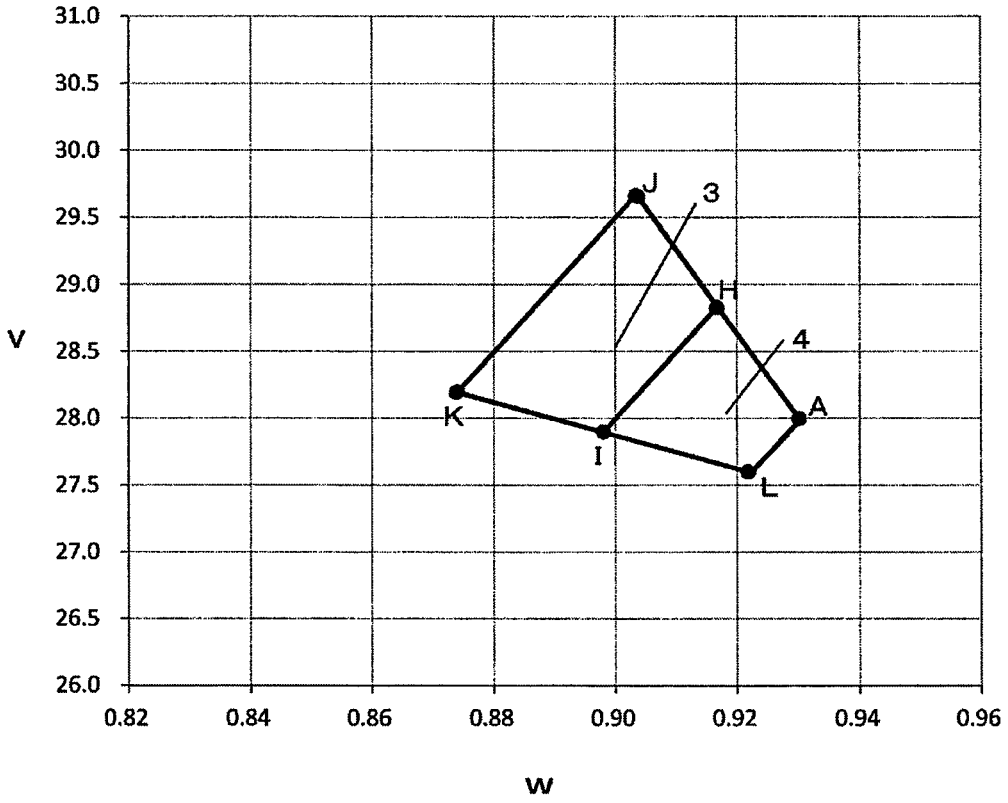
FIG. 2 is an explanatory graph showing ranges of v and w in another aspect of the present invention.
Figure 3:
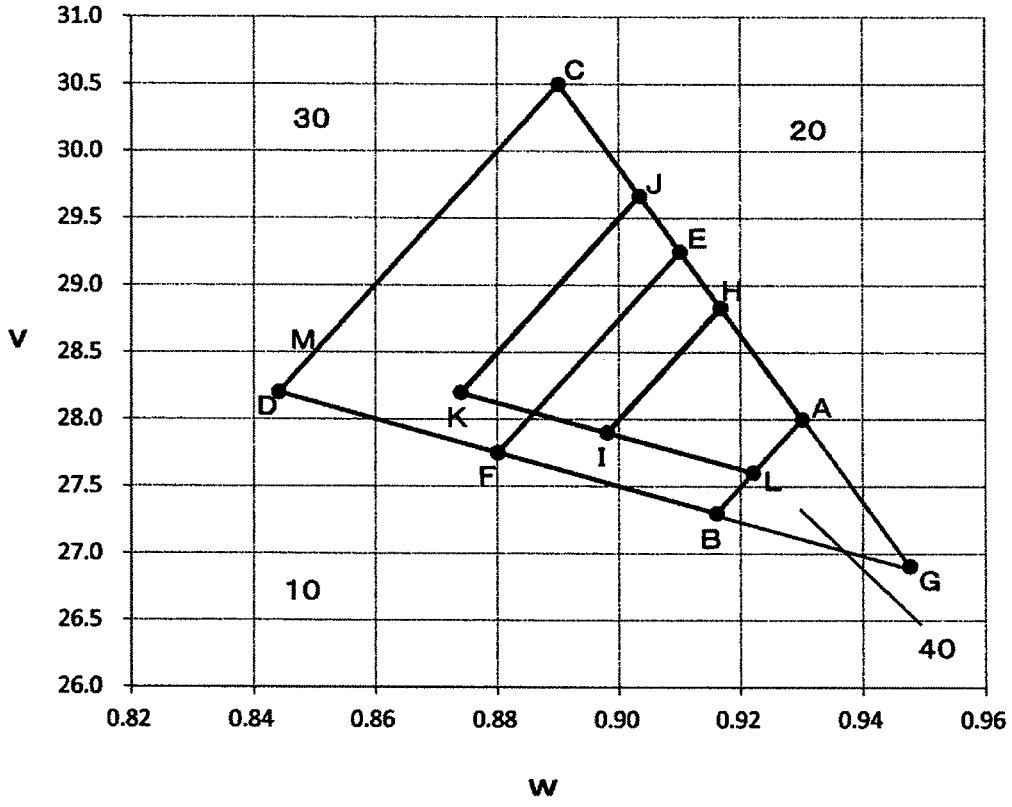
FIG. 3 is an explanatory graph showing the relative relationship between ranges shown in FIG. 1 and ranges shown in FIG. 2.

The ranges of the present invention of v and w, which satisfy the inequality expressions (8) and (9), are shown in FIG. 2. The inequality expression (8), namely, $50w-18.5\leq v\leq 50w-15.5$ corresponds to the range held between a straight line including a point A and a point L, and a straight line including a point J and a point K in FIG. 2, and the inequality expression (9), namely, $-12.5w+39.125$ $v-62.5w+86.125$ corresponds to the range held between a straight line including a point K, a point I and a point L, and a straight line including a point J, a point H and a point A. The regions 3 and 4 (region surrounded by a point A, a point L, a point K and a point J) satisfying both regions are within the range according to one aspect of the present invention. For your reference, the positional relationship (relative relationship between the range shown in FIG. 1 and the range shown in FIG. 2) between FIG. 1 (when the amount of Ga is 0.40% by mass or more and 0.70% by mass or less) and FIG. 2 (when the amount of Ga is 0.20% by mass or more and less than 0.40% by mass) is shown in FIG. 3. Even if x (the amount of Ga) is 0.20% by mass or more and less than 0.40% by mass, high $B_r$ and high $H_{cJ}$ can be obtained by setting appropriate x in accordance with v and w within the above range (regions 3 and 4 surrounded by a point A, a point L, a point K and a point J).

In the present invention, when the amount of Ga is 0.40% by mass or more and 0.70% by mass or less, more preferably, v and w have the following relationship of the inequality expressions (11) and (7):

$$50w-18.5 \le v \le 50w-16.25 \quad (11)$$

$$-12.5w+38.75 \le v \le -62.5w+86.125 \quad (7).$$

The ranges of the present invention of v and w, which satisfy the inequality expressions (11) and (7), are shown in FIG. 1. The inequality expression (11), namely, $50w-18.5 \le v \le 50w-16.25$ corresponds to the range held between a straight line including a point A and a point B, and a straight line including a point E and a point F, and the inequality expression (7), namely, $-12.5w+38.75 \le v \le -62.5w+86.125$ corresponds to the range held between a straight line including a point D, a point F, a point B and a point G, and a straight line including a point C, a point E, a point A and a point G. The region 2 (region surrounded by a point A, a point B, a point F and a point E) satisfying both regions is within the range according to one aspect of the present invention. With the above composition, it is possible to decrease v and to increase w while securing the formation amount of the R-T-Ga phase, so that an existence ratio of a main phase does not decrease, thus obtaining higher $B_r$.

In the present invention, when the amount of Ga is 0.20% by mass or more and less than 0.40% by mass, more preferably, v and w have the relationship of the following inequality expressions (12) and (9).

$$50w-18.5 \le v \le 50w-17.0 \quad (12)$$

$$-12.5w+39.125 \le v \le -62.5w+86.125 \quad (9)$$

The range, which satisfies the inequality expressions (12) and (9), is shown in FIG. 2. The inequality expression (12), namely, $50w-18.5 \le v \le 50w-17.0$ corresponds to the range held between a straight line including a point A and a point L, and a straight line including a point H and a point I, and the inequality expression (9), namely, $-12.5w+39.125 \le v \le -62.5w+86.125$ corresponds to the range held between a straight line including a point K, a point I and a point L, and a straight line including a point J, a point H and a point A. The region 4 (region surrounded by a point A, a point L, a point I and a point H) satisfying both regions is within the range according to one aspect of the present invention. The range corresponds to the inequality expression (8) and the inequality expression (5) in the aspect 4. For your reference, the relative positional relationship between FIG. 1 (the amount of Ga is 0.40% by mass or more and 0.70% by mass or less) and FIG. 2 (the amount of Ga is 0.20% by mass or more and less than 0.40% by mass) is shown in FIG. 3. By adjusting within the above range (region 4 surrounded by a point A, a point L, a point I and a point H) and also adjusting x within the rage of $-(62.5w+v-81.625)/15+0.5 \le x \le -(62.5w+v-81.625)/15+0.8$ as mentioned above, it is possible to decrease v and to increase w while securing the formation amount of the R-T-Ga phase, so that an existence ratio of the main phase is not decreased, thus obtaining higher $B_r$.

Cu is included in the amount of 0.07% by mass or more and 0.2% by mass or less. If the content of Cu is less than 0.07% by mass, the R-Ga phase and the R-Ga—Cu phase may not be easily formed on the grain boundary between two grains, thus failing to obtain high $H_{cJ}$. If the content of Cu exceeds 0.2% by mass, the content of Cu may be too large to perform sintering. The content of Cu is more preferably 0.08% by mass or more and 0.15% by mass or less.

Al (0.05% by mass or more 0.5% by mass or less) may also be included to the extent to be usually included. $H_{cJ}$ can be improved by including Al. In the production process, 0.05% by mass or more of Al may be usually included as inevitable impurities, and is included in the total amount (the amount of Al included as inevitable impurities and the amount of intentionally added Al) of 0.05% by mass or more and 0.5% by mass or less.

It has generally been known that abnormal grain growth of crystal grains during sintering is suppressed by including Nb and/or Zr in the R-T-B based sintered magnet. In the present invention, Nb and/or Zr may be included in the total amount of 0.1% by mass or less. If the total content of Nb and/or Zr exceeds 0.1% by mass, a volume fraction of the main phase may be decreased by the existence of unnecessary Nb and/or Zr, leading to a reduction in $B_r$.

The amount of oxygen (% by mass), the amount of nitrogen (% by mass) and the amount of carbon (% by mass) in the aspect according to the present invention are the content (namely, the content in case where the mass of the entire R-T-B based magnet is 100% by mass) in the R-T-B based sintered magnet. In the present invention, the value (v), which is obtained by subtracting the amount consumed as a result of bonding to oxygen, nitrogen and carbon from the amount of R(u) using the method described below, is used. By using v, it becomes possible to adjust the formation amount of the $R_2T_{17}$ or R-T-Ga phase. The above-mentioned v is determined by subtracting $6\alpha+10\beta+8\gamma$, where the amount of oxygen (% by mass) is $\alpha$, the amount of nitrogen (% by mass) is $\beta$, and the amount of carbon (% by mass) is $\gamma$, from the amount of R(u). $6\alpha$ has been defined since an oxide of $R_2O_3$ is mainly formed as impurities, so that R with about 6 times by mass of oxygen is consumed as the oxide. $10\beta$ has been defined since a nitride of RN is mainly formed so that R with about 10 times by mass of nitrogen is consumed as the nitride. $8\gamma$ has been defined since a carbide of $R_2C_3$ is mainly formed so that R with about 8 times by mass of carbon is consumed as the carbide. For the amount of oxygen (% by mass), the amount of nitrogen (% by mass) and the amount of carbon (% by mass) in the present invention, the amount of oxygen, the amount of nitrogen and the amount of carbon of the R-T-B based sintered magnet obtained finally can be predicted by considering a raw material alloy, production conditions to be used, and the like. In the R-T-B based sintered magnet obtained finally, the amount of oxygen can be measured using a gas fusion-infrared absorption method, the amount of nitrogen can be measured using a gas fusion-thermal conductivity method, and the amount of carbon can be measured using a combustion infrared absorption method, using a gas analyzer.

The amount of oxygen, the amount of nitrogen, and the amount of carbon are respectively obtained by the measurement using the above-mentioned gas analyzer, whereas u, w, x, y, z and q among u, w, x, y, z, q and 100u-w-x-y-z-q, which are the respective contents (% by mass) of R, B, Ga, Cu, Al, M and T shown in the formula (1), may be measured using high-frequency inductively coupled plasma emission spectrometry (ICP optical emission spectrometry, ICP-OES). 100u-w-x-y-z-q may be determined by calculation using the measured values of u, w, x, y, z and q obtained by ICP optical emission spectrometry.

Accordingly, the formula (1) is defined so that the total amount of elements measurable by ICP optical emission spectrometry becomes 100% by mass. Meanwhile, the amount of oxygen, the amount of nitrogen, and the amount of carbon are unmeasurable by ICP optical emission spectrometry.

Therefore, in the aspect according to the present invention, it is permissible that the total amount of u, w, x, y, z, q and 100u-w-x-y-z-q defined in the formula (1), the amount of oxygen $\alpha$, the amount of nitrogen $\beta$ and the amount of carbon $\gamma$ exceeds 100% by mass.

The amount of oxygen of the R-T-B based sintered magnet is preferably 0.15% by mass or less. Since v is the value obtained by subtracting $6\alpha+10\beta+8\gamma$, where the amount of oxygen (% by mass) is $\alpha$, the amount of nitrogen (% by mass) is $\beta$, and the amount of carbon (% by mass) is $\gamma$, from the amount of R (u), there is a need to increase the amount of R in the stage of the raw material alloy in the case of a large amount of oxygen ($\alpha$). Particularly, among the regions 1 and 2 in FIG. 1 mentioned below, the region 1 exhibits relatively higher v than that of the region 2, so that the amount of R may significantly increase in the stage of the raw material alloy in the case of a large amount of oxygen ($\alpha$). Whereby, an existence ratio of a main phase decreases, leading to a reduction in $B_r$. Therefore, in the region 1 of the present invention of FIG. 1, the amount of oxygen is particularly preferably 0.15% by mass or less.

In one aspect of the present invention, the R-T-Ga phase includes: R: 15% by mass or more and 65% by mass or less, T: 20% by mass or more and 80% by mass or less, and Ga: 2% by mass or more and 20% by mass or less, and examples thereof include an $R_6Fe_{13}Ga_1$ compound. The R-Ga phase includes: R: 70% by mass or more 95% by mass or less, Ga: 5% by mass or more 30% by mass or less, and Fe: 20% by mass or less (including 0), and examples thereof include an $R_3Ga_1$ compound. Furthermore, the R-Ga—Cu phase is obtained by replacing a part of the R-Ga phase of Ga with Cu, and examples thereof include an $R_3(Ga,Cu)_1$ compound. In the present invention, the R-T-Ga phase may include Cu, Al or Si, and the R-Ga—Cu phase may include Al, Fe or Co. Here, Al includes Al which is inevitably introduced from a melting pot or the like during melting of the raw material alloy.

[High-Temperature Heat Treatment Step]

The R-T-B based sintered magnet material obtained is heated to a temperature of 730° C. or higher and 1,020° C. or lower, and then cooled to 300° C. or lower at a cooling rate of 20° C./min or more (more specifically, to 300° C. at a cooling rate of 20° C./min or more). In the present invention, this heat treatment is referred to as a high-temperature heat treatment step. The high-temperature heat treatment step can eliminate the R-T-Ga phase formed during sintering. If the temperature in the high-temperature heat treatment step is lower than 730° C., the R-T-Ga phase may not be eliminated since the temperature is too low, and if the temperature is higher than 1,020° C., grain growth may occur, leading to a reduction in $H_{cJ}$. The heating time is preferably 5 minutes or more and 500 minutes or less. If a cooling rate during cooling to 300° C. or lower (more specifically, to 300° C. at a cooling rate of 20° C./min or more) after heating to 730° C. or higher and 1,020° C. or lower is less than 20° C./min, an excessive R-T-Ga phase may be formed. Similarly, a cooling rate is 20° C./min or more before the temperature reaches 300° C., an excessive R-T-Ga phase may be formed. A cooling rate during cooling to 300° C. or lower (more specifically, to 300° C. at a cooling rate of 20° C./min or more) after heating to 730° C. or higher and 1,020° C. or lower may be 20° C./min or more, and the cooling rate may vary. For example, immediately after the initiation of cooling, the cooling rate may be about 40° C./min, and may be changed to 35° C./min or 30° C./min or the like as the temperature gets close to 300° C.

As a method for assessing a cooling rate during cooling to 300° C. after heating to a heating temperature of 730° C. or higher and 1,020° C. or lower, assessment may be performed with average cooling rate during cooling from the heating temperature to 300° C. (namely, the value obtained by dividing the value obtained by subtracting the temperature difference between the heating temperature and 300° C. from the heating temperature, by time to reach 300° C.)

As mentioned above, in the R-T-B based sintered magnet according to the present invention, a sufficient amount of the R-Ga—Cu phase is obtained by suppressing formation of the R-T-Ga phase, as mentioned above. Although there is a need to form the R-T-Ga phase so as to obtain high $H_{cJ}$, it is important to form the R-Ga—Cu phase by suppressing the formation as small as possible. Therefore, in the R-T-B based sintered magnet according to the present invention, formation of the R-T-Ga phase may be suppressed so that a sufficient amount of the R-Ga—Cu phase is obtained, and a certain amount of the R-T-Ga phase may exist.

[Low-Temperature Heat Treatment Step]

The R-T-B based sintered magnet material after the high-temperature heat treatment step is heated to a temperature of 440° C. or higher and 550° C. or lower. In the present invention, this heat treatment is referred to as a low-temperature heat treatment step. Whereby, the R-T-Ga phase is formed. If the temperature in the low-temperature heat treatment step is lower than 440° C., the R-T-Ga phase may not be formed, and if the temperature is higher than 550° C., the formation amount of the R-T-Ga phase may be excessive, leading to insufficient formation amounts of the R-Ga phase and the R-Ga—Cu phase on the grain boundary between two grains. The temperature in low-temperature heat treatment step is preferably 480° C. or higher and 550° C. or lower. The heating time is preferably 5 minutes or more and 500 minutes or less. There is no particular limitation on a cooling rate after heating to 440° C. or higher and 550° C. or lower.

To adjust the size of the magnet, the obtained R-T-B based sintered magnet may be subjected to machining such as grinding. In that case, the high-temperature heat treatment step and the low-temperature heat treatment step may be performed before or after machining. The sintered magnet may also be subjected to a surface treatment. The surface treatment may be a known surface treatment, and it is possible to perform surface treatments, for example, Al vapor deposition, Ni electroplating, resin coating, and the like.

EXAMPLES

The present invention will be described in more detail below by way of Examples, but the present invention is not limited thereto.

Example 1

Nd metal, Pr metal, Dy metal, Tb metal, ferroboron alloy, electrolytic Co, Al metal, Cu metal, Ga metal, ferro-niobium alloy, ferro-zirconium alloy and electrolytic iron (any of metals has a purity of 99% by mass or more) were mixed so as to obtain a given composition, and then these raw materials were melted and subjected to casting by a strip casting method to obtain a flaky raw material alloy having a thickness of 0.2 to 0.4 mm. The flaky raw material alloy thus obtained was subjected to hydrogen grinding in a hydrogen atmosphere under an increased pressure and then subjected to a dehydrogenation treatment of heating to 550° C. in vacuum and cooling to obtain a coarsely pulverized powder. To the coarsely pulverized powder thus obtained, zinc stearate was added as a lubricant in the proportion of 0.04% by mass based on 100% by mass of the coarsely pulverized powder, followed by mixing. Using an air flow-type pulverizer (jet milling machine), the mixture was subjected to dry pulverization in a nitrogen gas flow to obtain a finely pulverized powder (alloy powder) having a grain size $D_{50}$ of 4 μm. By mixing the nitrogen gas with atmospheric air during pulverization, the oxygen concentration in a nitrogen gas during pulverization was adjusted. When mixing with no atmospheric air, the oxygen concentration in the nitrogen gas during pulverization is 50 ppm or less and the oxygen concentration in the nitrogen gas was increased to 5,000 ppm at a maximum by mixing with atmospheric air to produce finely pulverized powders each having a different oxygen amount. The grain size $D_{50}$ is a median size on a volume basis obtained by a laser diffraction method using an air flow dispersion method. In Table 1, O (amount of oxygen) was measured by a gas fusion-infrared absorption method, N (amount of nitrogen) was measured by a gas fusion-thermal conductivity method, and C (amount of carbon) was measured by a combustion infrared absorption method, using a gas analyzer.

To the finely pulverized powder, zinc stearate was added as a lubricant in the proportion of 0.05% by mass based on 100% by mass of the finely pulverized powder, followed by mixing and further compacting in a magnetic field to obtain a compact. A compacting device used was a so-called perpendicular magnetic field compacting device (transverse magnetic field compacting device) in which a magnetic field application direction and a pressuring direction are perpendicular to each other.

The compact thus obtained was sintered in vacuum at 1,020° C. for 4 hours to obtain an R-T-B-based sintered magnet material. The R-T-B based sintered magnet material had a density of 7.5 $Mg/m^3$ or more. To determine a composition of the R-T-B based sintered magnet material thus obtained, the contents of Nd, Pr, Dy, Tb, B, Co, Al, Cu, Ga, Nb, and Zr were measured by ICP optical emission spectrometry. The measurement results are shown in Table 1. Balance (obtained by subtracting the contents of Nd, Pr, Dy, Tb, B, Co, Al, Cu, Ga, Nb, and Zr, obtained as a result of the measurement, from 100% by mass) was regarded as the content of Fe. Furthermore, gas analysis results (O, N, and C) are shown in Table 1. The R-T-B based sintered magnet material thus obtained was subjected to a high-temperature heat treatment step. In the high-temperature heat treatment step, the R-T-B based sintered magnet material was heated to 900° C. and retained for 3 hours, followed by cooling to room temperature. By introducing argon gas into a furnace, the cooling was performed at an average cooling rate of 25° C./min during cooling from the retained temperature (900° C.) to 300° C., and at an average cooling rate of 3° C./rain during cooling from 300° C. to room temperature. A variation in average cooling rate (25° C./min and 3° C./min) (difference between the maximum value and the minimum value of the cooling rate) was within 3° C./min for any of samples. Then, the R-T-B based sintered magnet material after the high-temperature heat treatment step was subjected to a low-temperature heat treatment step. In the low-temperature heat treatment step, the R-T-B based sintered magnet material was heated to 500° C. and retaining for 2 hours, followed by cooling to room temperature at a cooling rate of 20° C./min. The heating temperature and the cooling rate in the high-temperature heat treatment step and the low-temperature heat treatment step were measured by attaching a thermocouple to the R-T-B based sintered magnet material. The R-T-B based sintered magnet thus obtained after the low-temperature heat treatment step was machined to produce samples of 7 mm in length×7 mm in width×7 mm in thickness, and then $B_r$ and $H_{cJ}$ of each sample were measured by a B—H tracer. The measurements results are shown in Table 2. The results of composition and gas analyses of the R-T-B based sintered magnet whose $B_r$ and $H_{cJ}$ were measured were identical to the results of composition and gas analyses of the R-T-B based sintered magnet material in Table 1.

TABLE 1

| | Analysis results of R-T-B-based sintered magnet material (% by mass) | | | | | | | | | | | | | | | |
|---|---|---|---|---|---|---|---|---|---|---|---|---|---|---|---|---|
| No. | Nd | Pr | Dy | Tb | B | Co | Al | Cu | Ga | Nb | Zr | Fe | O | N | C | |
| 1 | 22.7 | 7.4 | 0 | 0 | 0.910 | 0.5 | 0.10 | 0.08 | 0.47 | 0.0 | 0.0 | bal. | 0.10 | 0.05 | 0.10 | Present invention |
| 2 | 22.7 | 7.4 | 0 | 0 | 0.910 | 0.5 | 0.05 | 0.08 | 0.47 | 0.0 | 0.0 | bal. | 0.10 | 0.05 | 0.10 | Present invention |
| 3 | 22.7 | 7.4 | 0 | 0 | 0.910 | 2.0 | 0.10 | 0.08 | 0.50 | 0.0 | 0.0 | bal. | 0.10 | 0.05 | 0.10 | Present invention |
| 4 | 22.7 | 7.4 | 0 | 0 | 0.910 | 0.5 | 0.05 | 0.08 | 0.40 | 0.1 | 0.0 | bal. | 0.10 | 0.05 | 0.10 | Present invention |
| 5 | 22.7 | 7.4 | 0 | 0 | 0.910 | 0.5 | 0.05 | 0.08 | 0.40 | 0.0 | 0.1 | bal. | 0.10 | 0.05 | 0.10 | Present invention |
| 6 | 22.7 | 7.4 | 0 | 0 | 0.910 | 0.5 | 0.05 | 0.08 | 0.40 | 0.03 | 0.05 | bal. | 0.10 | 0.05 | 0.10 | Present invention |
| 7 | 22.7 | 7.4 | 0 | 0 | 0.900 | 0.5 | 0.30 | 0.08 | 0.40 | 0.00 | 0.0 | bal. | 0.10 | 0.05 | 0.10 | Present invention |
| 8 | 22.7 | 7.4 | 0 | 0 | 0.900 | 0.5 | 0.30 | 0.08 | 0.30 | 0.00 | 0.0 | bal. | 0.10 | 0.05 | 0.10 | Comparative Example |
| 9 | 22.7 | 7.4 | 0 | 0 | 0.910 | 0.5 | 0.10 | 0.08 | 0.70 | 0.00 | 0.0 | bal. | 0.10 | 0.05 | 0.10 | Present invention |
| 10 | 22.7 | 7.4 | 0 | 0 | 0.910 | 0.0 | 0.50 | 0.08 | 0.47 | 0.00 | 0.0 | bal. | 0.10 | 0.05 | 0.10 | Present invention |
| 11 | 23.0 | 7.6 | 0 | 0 | 0.910 | 0.5 | 0.20 | 0.12 | 0.46 | 0.00 | 0.0 | bal. | 0.39 | 0.01 | 0.08 | Present invention |
| 12 | 23.0 | 7.6 | 0 | 0 | 0.907 | 0.5 | 0.20 | 0.12 | 0.48 | 0.00 | 0.0 | bal. | 0.44 | 0.01 | 0.08 | Comparative Example |
| 13 | 23.0 | 7.6 | 0 | 0 | 0.905 | 0.5 | 0.20 | 0.12 | 0.46 | 0.00 | 0.0 | bal. | 0.08 | 0.04 | 0.09 | Present invention |
| 14 | 23.1 | 7.6 | 0 | 0 | 0.937 | 0.5 | 0.20 | 0.13 | 0.47 | 0.00 | 0.0 | bal. | 0.08 | 0.04 | 0.09 | Comparative Example |
| 15 | 23.1 | 7.6 | 0 | 0 | 0.920 | 0.5 | 0.20 | 0.12 | 0.47 | 0.00 | 0.0 | bal. | 0.08 | 0.05 | 0.09 | Comparative Example |
| 16 | 23.1 | 7.6 | 0 | 0 | 0.878 | 0.5 | 0.20 | 0.12 | 0.48 | 0.00 | 0.0 | bal. | 0.41 | 0.01 | 0.08 | Comparative Example |
| 17 | 23.0 | 7.7 | 0 | 0 | 0.930 | 0.5 | 0.20 | 0.13 | 0.48 | 0.00 | 0.0 | bal. | 0.41 | 0.01 | 0.08 | Comparative Example |
| 18 | 23.0 | 7.7 | 0 | 0 | 0.897 | 0.5 | 0.20 | 0.12 | 0.47 | 0.00 | 0.0 | bal. | 0.40 | 0.01 | 0.08 | Present invention |
| 19 | 23.1 | 7.6 | 0 | 0 | 0.934 | 0.5 | 0.20 | 0.14 | 0.50 | 0.00 | 0.0 | bal. | 0.24 | 0.03 | 0.08 | Comparative Example |
| 20 | 23.1 | 7.7 | 0 | 0 | 0.887 | 0.5 | 0.20 | 0.12 | 0.47 | 0.00 | 0.0 | bal. | 0.39 | 0.01 | 0.07 | Present invention |
| 21 | 23.1 | 7.7 | 0 | 0 | 0.894 | 0.5 | 0.20 | 0.12 | 0.47 | 0.00 | 0.0 | bal. | 0.07 | 0.05 | 0.09 | Present invention |
| 22 | 23.1 | 7.7 | 0 | 0 | 0.860 | 0.5 | 0.20 | 0.12 | 0.47 | 0.00 | 0.0 | bal. | 0.39 | 0.01 | 0.09 | Comparative Example |
| 23 | 23.1 | 7.7 | 0 | 0 | 0.937 | 0.5 | 0.20 | 0.13 | 0.10 | 0.00 | 0.0 | bal. | 0.43 | 0.01 | 0.08 | Comparative Example |
| 24 | 23.4 | 7.4 | 0 | 0 | 0.974 | 0.5 | 0.20 | 0.15 | 0.49 | 0.00 | 0.0 | bal. | 0.08 | 0.04 | 0.09 | Comparative Example |

TABLE 1-continued

| | Analysis results of R-T-B-based sintered magnet material (% by mass) | | | | | | | | | | | | | | | |
|---|---|---|---|---|---|---|---|---|---|---|---|---|---|---|---|---|
| No. | Nd | Pr | Dy | Tb | B | Co | Al | Cu | Ga | Nb | Zr | Fe | O | N | C | |
| 25 | 23.2 | 7.7 | 0 | 0 | 0.850 | 0.5 | 0.20 | 0.16 | 0.47 | 0.00 | 0.0 | bal. | 0.24 | 0.03 | 0.09 | Present invention |
| 26 | 23.2 | 7.6 | 0 | 0 | 0.918 | 0.5 | 0.20 | 0.13 | 0.49 | 0.00 | 0.0 | bal. | 0.23 | 0.03 | 0.08 | Present invention |
| 27 | 23.2 | 7.7 | 0 | 0 | 0.850 | 0.5 | 0.20 | 0.12 | 0.52 | 0.00 | 0.0 | bal. | 0.08 | 0.06 | 0.09 | Comparative Example |
| 28 | 23.2 | 7.7 | 0 | 0 | 0.875 | 0.5 | 0.10 | 0.20 | 0.55 | 0.00 | 0.0 | bal. | 0.08 | 0.04 | 0.09 | Present invention |
| 29 | 23.3 | 7.6 | 0 | 0 | 0.890 | 0.5 | 0.20 | 0.15 | 0.48 | 0.00 | 0.0 | bal. | 0.22 | 0.04 | 0.08 | Present invention |
| 30 | 23.4 | 7.6 | 0 | 0 | 0.896 | 0.5 | 0.20 | 0.15 | 0.10 | 0.00 | 0.0 | bal. | 0.08 | 0.05 | 0.10 | Comparative Example |
| 31 | 23.4 | 7.6 | 0 | 0 | 0.904 | 0.5 | 0.20 | 0.16 | 0.49 | 0.00 | 0.0 | bal. | 0.07 | 0.05 | 0.11 | Present invention |
| 32 | 23.3 | 7.9 | 0 | 0 | 0.830 | 0.5 | 0.30 | 0.11 | 0.15 | 0.00 | 0.0 | bal. | 0.10 | 0.05 | 0.09 | Comparative Example |
| 33 | 23.3 | 7.9 | 0 | 0 | 0.830 | 0.5 | 0.30 | 0.11 | 0.15 | 0.00 | 0.0 | bal. | 0.40 | 0.02 | 0.09 | Comparative Example |
| 34 | 23.6 | 7.7 | 0 | 0 | 0.883 | 0.5 | 0.30 | 0.15 | 0.48 | 0.00 | 0.0 | bal. | 0.08 | 0.05 | 0.11 | Present invention |
| 35 | 23.7 | 7.6 | 0 | 0 | 0.910 | 0.5 | 0.30 | 0.15 | 0.51 | 0.00 | 0.0 | bal. | 0.09 | 0.05 | 0.10 | Comparative Example |
| 36 | 23.6 | 7.7 | 0 | 0 | 0.891 | 0.5 | 0.30 | 0.15 | 0.94 | 0.00 | 0.0 | bal. | 0.08 | 0.05 | 0.10 | Comparative Example |
| 37 | 23.6 | 7.8 | 0 | 0 | 0.890 | 0.5 | 0.20 | 0.16 | 0.50 | 0.00 | 0.0 | bal. | 0.07 | 0.03 | 0.07 | Present invention |
| 38 | 23.7 | 7.7 | 0 | 0 | 0.910 | 0.5 | 0.20 | 0.15 | 0.51 | 0.00 | 0.0 | bal. | 0.08 | 0.04 | 0.08 | Comparative Example |
| 39 | 24.0 | 8.0 | 0 | 0 | 0.870 | 0.5 | 0.10 | 0.05 | 0.57 | 0.00 | 0.0 | bal. | 0.10 | 0.05 | 0.09 | Comparative Example |
| 40 | 24.0 | 8.0 | 0 | 0 | 0.870 | 0.5 | 0.10 | 0.05 | 0.57 | 0.00 | 0.0 | bal. | 0.43 | 0.02 | 0.09 | Comparative Example |
| 41 | 24.0 | 8.0 | 0 | 0 | 0.860 | 0.5 | 0.10 | 0.30 | 0.57 | 0.00 | 0.0 | bal. | 0.10 | 0.05 | 0.09 | Comparative Example |
| 42 | 24.0 | 8.0 | 0 | 0 | 0.860 | 0.5 | 0.10 | 0.30 | 0.57 | 0.00 | 0.0 | bal. | 0.41 | 0.02 | 0.09 | Comparative Example |
| 43 | 24.2 | 8.1 | 0 | 0 | 0.900 | 0.5 | 0.20 | 0.14 | 0.45 | 0.00 | 0.0 | bal. | 0.09 | 0.05 | 0.11 | Comparative Example |
| 44 | 24.3 | 8.2 | 0 | 0 | 0.883 | 0.5 | 0.20 | 0.13 | 0.46 | 0.00 | 0.0 | bal. | 0.10 | 0.05 | 0.11 | Comparative Example |
| 45 | 24.5 | 8.3 | 0 | 0 | 0.937 | 0.5 | 0.20 | 0.13 | 0.10 | 0.00 | 0.0 | bal. | 0.43 | 0.01 | 0.08 | Comparative Example |
| 46 | 23.0 | 7.6 | 0 | 0 | 0.923 | 0.5 | 0.20 | 0.12 | 0.48 | 0.00 | 0.0 | bal. | 0.39 | 0.01 | 0.08 | Comparative Example |
| 47 | 21.3 | 7.0 | 2 | 0 | 0.940 | 0.5 | 0.10 | 0.13 | 0.10 | 0.00 | 0.0 | bal. | 0.10 | 0.05 | 0.10 | Comparative Example |
| 48 | 21.5 | 7.1 | 0 | 2 | 0.905 | 0.5 | 0.10 | 0.12 | 0.46 | 0.00 | 0.0 | bal. | 0.39 | 0.01 | 0.08 | Present invention |
| 49 | 21.5 | 7.1 | 2 | 0 | 0.905 | 0.5 | 0.10 | 0.12 | 0.46 | 0.00 | 0.0 | bal. | 0.39 | 0.01 | 0.08 | Present invention |
| 50 | 21.5 | 7.2 | 2 | 0 | 0.944 | 0.5 | 0.10 | 0.13 | 0.10 | 0.00 | 0.0 | bal. | 0.40 | 0.01 | 0.08 | Comparative Example |
| 51 | 21.5 | 7.2 | 2 | 0 | 0.890 | 0.5 | 0.10 | 0.13 | 0.10 | 0.00 | 0.0 | bal. | 0.40 | 0.01 | 0.08 | Comparative Example |
| 52 | 20.7 | 6.7 | 4 | 0 | 0.940 | 0.5 | 0.10 | 0.12 | 0.10 | 0.00 | 0.0 | bal. | 0.40 | 0.01 | 0.08 | Comparative Example |
| 53 | 20.7 | 6.7 | 4 | 0 | 0.894 | 0.5 | 0.10 | 0.12 | 0.46 | 0.00 | 0.0 | bal. | 0.40 | 0.01 | 0.08 | Present invention |
| 54 | 20.7 | 6.7 | 3 | 0 | 0.905 | 0.5 | 0.10 | 0.08 | 0.40 | 0.00 | 0.0 | bal. | 0.10 | 0.05 | 0.10 | Present invention |
| 55 | 20.7 | 6.7 | 3 | 0 | 0.905 | 0.5 | 0.10 | 0.08 | 0.26 | 0.00 | 0.0 | bal. | 0.10 | 0.05 | 0.10 | Comparative Example |
| 56 | 30.3 | 0.0 | 0 | 0 | 0.910 | 0.5 | 0.05 | 0.08 | 0.47 | 0.00 | 0.0 | bal. | 0.10 | 0.05 | 0.10 | Present invention |
| 57 | 21.5 | 7.1 | 1 | 1 | 0.905 | 0.5 | 0.10 | 0.12 | 0.46 | 0.00 | 0.0 | bal. | 0.39 | 0.01 | 0.08 | Present invention |

TABLE 2

| No. | u | v | w | Region | $B_r$ (T) | $H_{cJ}$ (kA/m) | |
|---|---|---|---|---|---|---|---|
| 1 | 30.1 | 28.20 | 0.910 | 2 | 1.396 | 1502 | Present invention |
| 2 | 30.1 | 28.20 | 0.910 | 2 | 1.411 | 1454 | Present invention |
| 3 | 30.1 | 28.20 | 0.910 | 2 | 1.401 | 1500 | Present invention |
| 4 | 30.1 | 28.20 | 0.910 | 2 | 1.407 | 1484 | Present invention |
| 5 | 30.1 | 28.20 | 0.910 | 2 | 1.408 | 1473 | Present invention |
| 6 | 30.1 | 28.20 | 0.910 | 2 | 1.409 | 1480 | Present invention |
| 7 | 30.1 | 28.20 | 0.900 | 2 | 1.386 | 1538 | Present invention |
| 8 | 30.1 | 28.20 | 0.900 | 2 | 1.387 | 1320 | Comparative Example |
| 9 | 30.1 | 28.20 | 0.910 | 2 | 1.396 | 1502 | Present invention |
| 10 | 30.1 | 28.20 | 0.910 | 2 | 1.367 | 1590 | Present invention |
| 11 | 30.6 | 27.50 | 0.910 | 2 | 1.354 | 1520 | Present invention |
| 12 | 30.6 | 27.19 | 0.907 | 10 | 1.356 | 1233 | Comparative Example |
| 13 | 30.6 | 28.97 | 0.905 | 2 | 1.369 | 1480 | Present invention |
| 14 | 30.7 | 29.08 | 0.937 | 20 | 1.391 | 1295 | Comparative Example |
| 15 | 30.7 | 28.98 | 0.920 | 20 | 1.383 | 1299 | Comparative Example |
| 16 | 30.7 | 27.52 | 0.878 | 10 | 1.338 | 1165 | Comparative Example |
| 17 | 30.7 | 27.54 | 0.930 | 40 | 1.389 | 1232 | Comparative Example |
| 18 | 30.7 | 27.51 | 0.897 | 2 | 1.354 | 1370 | Present invention |
| 19 | 30.7 | 28.32 | 0.934 | 20 | 1.390 | 1269 | Comparative Example |
| 20 | 30.8 | 27.79 | 0.887 | 2 | 1.364 | 1360 | Present invention |
| 21 | 30.8 | 29.16 | 0.894 | 1 | 1.353 | 1545 | Present invention |
| 22 | 30.8 | 27.67 | 0.860 | 10 | 1.315 | 1030 | Comparative Example |
| 23 | 30.8 | 27.52 | 0.937 | 20 | 1.398 | 1200 | Comparative Example |
| 24 | 30.8 | 29.20 | 0.974 | 20 | 1.395 | 1220 | Comparative Example |

TABLE 2-continued

| No. | u | v | w | Region | $B_r$ (T) | $H_{cJ}$ (kA/m) | |
|---|---|---|---|---|---|---|---|
| 25 | 30.9 | 28.50 | 0.850 | 1 | 1.340 | 1400 | Present invention |
| 26 | 30.8 | 28.48 | 0.918 | 2 | 1.378 | 1510 | Present invention |
| 27 | 30.9 | 29.11 | 0.850 | 30 | 1.313 | 1620 | Comparative Example |
| 28 | 30.9 | 29.23 | 0.875 | 1 | 1.343 | 1568 | Present invention |
| 29 | 30.9 | 28.58 | 0.890 | 1 | 1.353 | 1490 | Present invention |
| 30 | 31.0 | 29.28 | 0.896 | 1 | 1.393 | 1292 | Comparative Example |
| 31 | 31.0 | 29.26 | 0.904 | 1 | 1.382 | 1448 | Present invention |
| 32 | 31.2 | 29.38 | 0.830 | 30 | 1.308 | 1570 | Comparative Example |
| 33 | 31.2 | 27.88 | 0.830 | 10 | 1.303 | 1530 | Comparative Example |
| 34 | 31.3 | 29.46 | 0.883 | 1 | 1.340 | 1567 | Present invention |
| 35 | 31.3 | 29.50 | 0.910 | 20 | 1.389 | 1290 | Comparative Example |
| 36 | 31.3 | 29.54 | 0.891 | 1 | 1.309 | 1580 | Comparative Example |
| 37 | 31.4 | 30.12 | 0.890 | 1 | 1.363 | 1593 | Present invention |
| 38 | 31.4 | 29.88 | 0.910 | 20 | 1.396 | 1290 | Comparative Example |
| 39 | 32.0 | 30.18 | 0.870 | 30 | 1.320 | 1440 | Comparative Example |
| 40 | 32.0 | 28.50 | 0.870 | 1 | 1.322 | 1400 | Comparative Example |
| 41 | 32.0 | 30.18 | 0.860 | 30 | 1.317 | 1460 | Comparative Example |
| 42 | 32.0 | 28.62 | 0.860 | 1 | 1.312 | 1420 | Comparative Example |
| 43 | 32.3 | 30.43 | 0.900 | 20 | 1.319 | 1378 | Comparative Example |
| 44 | 32.5 | 30.48 | 0.883 | 30 | 1.316 | 1475 | Comparative Example |

TABLE 2-continued

| No. | u | v | w | Region | $B_r$ (T) | $H_{cJ}$ (kA/m) | |
|---|---|---|---|---|---|---|---|
| 45 | 32.8 | 29.52 | 0.937 | 20 | 1.356 | 1281 | Comparative Example |
| 46 | 30.6 | 27.48 | 0.923 | 40 | 1.374 | 1300 | Comparative Example |
| 47 | 30.3 | 28.40 | 0.940 | 20 | 1.389 | 1492 | Comparative Example |
| 48 | 30.6 | 27.48 | 0.905 | 2 | 1.317 | 1960 | Present invention |
| 49 | 30.6 | 27.48 | 0.905 | 2 | 1.317 | 1800 | Present invention |
| 50 | 30.7 | 27.58 | 0.944 | 20 | 1.360 | 1490 | Comparative Example |
| 51 | 30.7 | 27.54 | 0.890 | 10 | 1.357 | 1272 | Comparative Example |
| 52 | 31.4 | 28.28 | 0.940 | 20 | 1.324 | 1730 | Comparative Example |
| 53 | 31.4 | 28.28 | 0.894 | 2 | 1.280 | 2051 | Present invention |
| 54 | 30.4 | 28.50 | 0.905 | 2 | 1.328 | 1978 | Present invention |
| 55 | 30.4 | 28.50 | 0.905 | 2 | 1.329 | 1760 | Comparative Example |
| 56 | 30.3 | 28.40 | 0.910 | 2 | 1.420 | 1400 | Present invention |
| 57 | 30.6 | 27.52 | 0.905 | 2 | 1.317 | 1880 | Present invention |

u in Table 2 is the value obtained by summing up the amounts of Nd, Pr, Dy, and Tb (% by mass) in Table 1, and v is the value obtained by subtracting $6\alpha+10\beta+8\gamma$, where the amount of oxygen (% by mass) is $\alpha$, the amount of nitrogen (% by mass) is $\beta$, and the amount of carbon (% by mass) is $\gamma$ in Table 1, from u. Regarding w, the amount of B (% by mass) in Table 1 was transferred as it is. The region in Table 2 indicates the position of the proportion of v and w in FIG. 1. The column in the table was filled with "1" when v and w exist in the region 1 in FIG. 1, while the column in the table was filled with "2" when v and w exist in the region 2 in FIG. 1. Furthermore, when v and w exist in the region except for the regions 1 and 2 in FIG. 1, the column in the table was filled with any one of 10, 20, 30, and 40 according to the position. For example, regarding No. 1, since v is 28.20% by mass and w is 0.910% by mass, and v and w exist in the region 2 in FIG. 1, the column in the table was filled with "2". Regarding No. 21, since v is 29.16% by mass and w is 0.894% by mass, and v and w exist in the region 1 in FIG. 1, the column in the table was filled with "1". Furthermore, regarding No. 47, since v is 28.40% by mass and w is 0.940% by mass, and v and w exist in the region 20 in FIG. 1, the column in the table was filled with "20".

Figure 4:
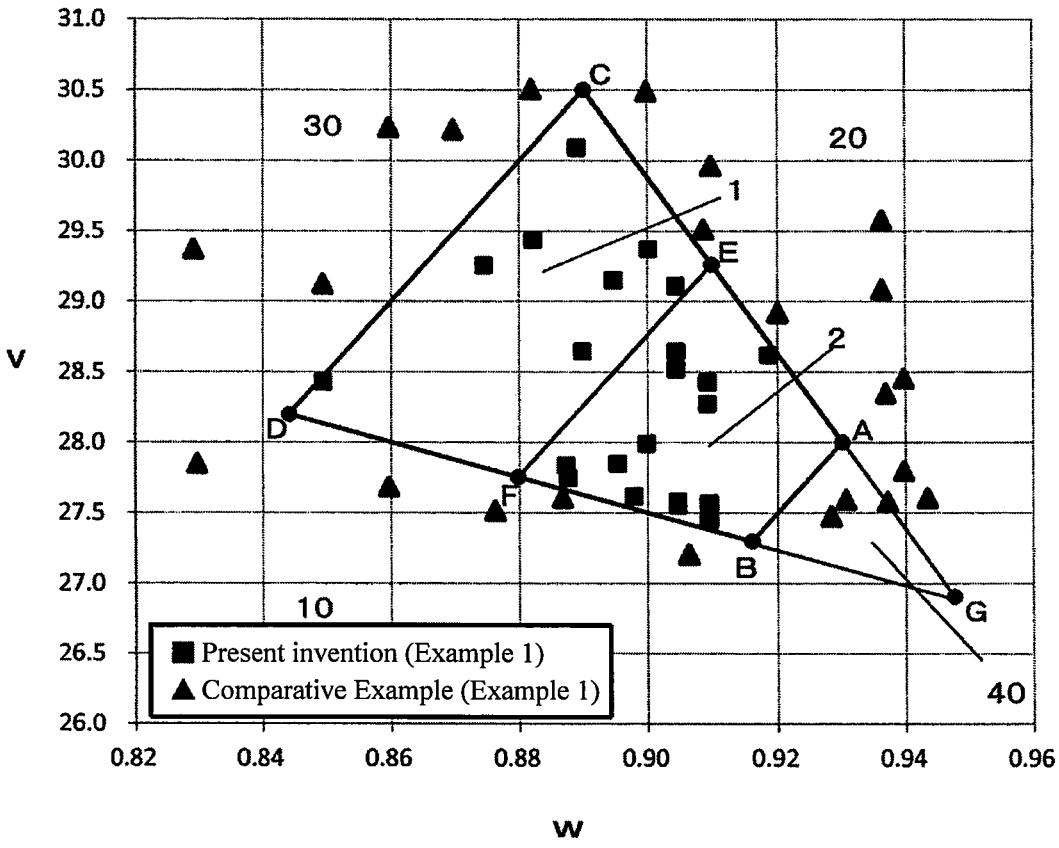
FIG. 4 is an explanatory graph showing the respective values of v and w of example samples and comparative example samples according to "<Example 1>" plotted in FIG. 1.

FIG. 4 is an explanatory graph showing the respective values of v and w of example samples and comparative example samples according to "<Example 1>" (namely, sample mentioned in Table 2) plotted in FIG. 1. From FIG. 4, it is possible to easily understand that example samples are within the range of the region 1 or 2, while comparative example samples deviate from the regions 1 and 2.

As mentioned above, in the present invention, if x is 0.40% by mass or more and 0.70% by mass or less, v and w are included in the following proportions:

$$50w-18.5 \le v \le 50w-14 \quad (6)$$

$$-12.5w+38.75 \le v \le -62.5w+86.125 \quad (7)$$

preferably $$50w-18.5 \le v \le 50w-16.25 \quad (11)$$

$$-12.5w+38.75 \le v \le -62.5w+86.125 \quad (7).$$

When included in the above proportion, the ranges of v and w correspond to the regions 1 and 2, or the region 2 in FIG. 1.

As shown in Table 2, when Dy and Tb are not included in the raw material alloy, any of example samples (example samples except for samples Nos. 48, 49, 53, 54 and 57), which exhibits the relationship between v and w located in the region of the present invention (regions 1 and 2 in FIG. 1), and also satisfies the following inequality expressions: $0.4 \le Ga\ (x) \le 0.7$, $0.07 \le Cu\ (y) \le 0.2$, $0.05 \le Al\ (z) \le 0.5$, and $0 \le M$ (Nb and/or Zr(q)) $\le 0.1$, has high magnetic properties of $B_r \ge 1.340T$ and $H_{cJ} \ge 1{,}360$ kA/m. Meanwhile, regarding Comparative Examples (for example, samples Nos. 12, 16, 22 and 35) in which the amounts of Ga, Cu and Al are within the range of the present invention but v and w deviate from the range of the present invention (region except for the region 1 or 2 in FIG. 1) and Comparative Examples (for example, samples Nos. 8, 30, 36, 40 and 42) in which v and w are within the range of the present invention (region 1 or 2 in FIG. 1) but the amounts of Ga and Cu deviate from the range of the present invention, high magnetic properties of $B_r \ge 1.340T$ and $H_{cJ} \le 1{,}360$ kA/m are not obtained. Particularly, as is apparent from sample No. 7 which is Example, and sample No. 8 which is Comparative Example with the same composition except that the content of Ga is 0.1% by mass lower than that of sample No. 7, $H_{cJ}$ is significantly decreased when Ga deviates from the range of the present invention even if v and w are within the range of the present invention. Regarding sample No. 08, the amount of Ga deviates from the range of Ga of the present invention $(-(62.5w+v-81.625)/15+0.5 \le x\ (Ga) \le -(62.5w+v-81.625)/15+0.8)$ if the amount of Ga is 0.20% by mass or more and less than 0.40% by mass, so that it is impossible to form the R-T-Ga phase minimally necessary for obtaining high magnetic properties, leading to significant reduction in $H_{cJ}$.

When Dy or Tb are included in the raw material alloy, $B_r$ is decreased and $H_{cJ}$ is improved according to the content of Dy or Tb. In this case, $B_r$ decreases by about 0.024T if 1% by mass of Dy or Tb is included. $H_{cJ}$ increases by about 160 kA/m if 1% by mass of Dy is included, and increases by about 240 kA/m if 1% by mass of Tb is included.

Therefore, in the present invention, when Dy and Tb are not included in the raw material alloy as mentioned above, because of having magnetic properties of $B_r \ge 1.340T$ and $H_{cJ} \ge 1{,}360$ kA/m, magnetic properties of $B_r(T) \ge 1.340-0.024Dy$ (% by mass) $-0.024Tb$ (% by mass) and $H_{cJ}$ (kA/m) $\ge 1{,}360+160$ Dy (% by mass)$+240$Tb (% by mass) are obtained according to the content of Dy or Tb.

As shown in Table 2, any of Examples (samples Nos. 48, 49, 53, 54 and 57) in which Dy and Tb are included in the raw material alloy has high magnetic properties of $B_r(T) \ge 1.340-0.024Dy$ (% by mass) $-0.024Tb$ (% by mass) and $H_{cJ}$ (kA/m) $\ge 1{,}360+160Dy$ (% by mass)$+240Tb$ (% by mass). Meanwhile, any of Comparative Examples (samples Nos. 47, 50, 51, 52 and 55) in which Dy and Tb are included does not have high magnetic properties of $B_r(T) \ge 1.340-0.024$ Dy (% by mass)$-0.024Tb$ (% by mass) and $H_{cj}$ (kA/m) $\ge 1{,}360+160Dy$ (% by mass)$+240Tb$ (% by mass). Particularly, as is apparent from sample No. 54 which is Example, and sample No. 55 which is Comparative Example with the same composition except that the content of Ga is 0.1% by mass lower than that of sample No. 54, $H_{cJ}$ is significantly decreased when Ga deviates from the range of the present invention even if v and w are within the range of the present invention. Regarding sample No. 55, the amount of Ga deviates from the range of Ga of the present invention $(-(62.5w+v-81.625)/15+0.5 \le x(Ga) \le -(62.5w+v-81.625)/15+0.8)$ when the amount of Ga is 0.20% by mass or more and less than 0.40% by mass, so that it is impossible to form the R-T-Ga phase minimally necessary for obtaining high magnetic properties, leading to significant reduction in $H_{cJ}$.

Furthermore, as shown in Table 2, in the present invention, it is possible to obtain higher $B_r$ ($B_r \geq 1.354T$ when Dy or Tb are not included in raw material alloy, $B_r \geq 1.354T - 0.024[Dy] - 0.024[Tb]$ when Dy and Tb are included in raw material alloy) in the region 2 (region 2 in FIG. 1) as compared with the region 1 (region 1 in FIG. 1). [Dy] or [Tb] represents each content (% by mass) of Dy or Tb.

Example 2

Nd metal, Pr metal, ferroboron alloy, electrolytic Co, Al metal, Cu metal, Ga metal and electrolytic iron (any of metals has a purity of 99% by mass or more) were mixed so as to obtain the same composition as that of sample No. 34 in Example 1, and then these raw materials were melted and subjected to casting by the same methods as in Example 1 to obtain a raw material alloy. The raw material alloy thus obtained was subjected to hydrogen treatment and dry pulverization by the same methods as in Example 1 to obtain a finely pulverized powder. Furthermore, compacting and sintering were performed by the same methods as in Example 1 to obtain an R-T-B based sintered magnet material. The R-T-B based sintered magnet material had a density of 7.5 $Mg/m^3$ or more. The results of composition and gas analyses of the R-T-B based sintered magnet material thus obtained were identical to those of sample No. 34 in Example 1.

The R-T-B based sintered magnet material thus obtained was subjected to a high-temperature heat treatment step under the conditions shown in Table 3, and the R-T-B based sintered magnet material after the high-temperature heat treatment step was subjected to a low-temperature heat treatment step under the conditions shown in Table 3. In Table 3, temperatures (° C.) in the high-temperature heat treatment step and the low-temperature heat treatment step are the heating temperatures of the R-T-B based sintered magnet material, and retention times (Hr) are the retention times at the heating temperature. Cooling rate (° C./min) represents an average cooling rate during cooling from the temperature at which the R-T-B based sintered magnet material was retained after the elapse of the retention time to 300° C. The cooling rates during cooling from 300° C. to room temperature in the high-temperature heat treatment step and the low-temperature heat treatment step were 3° C./min for any of samples. A variation in average cooling rate (from the retained temperature to 300° C., and from 300° C. to room temperature) (difference between the maximum value and the minimum value of the cooling rate) was within 3° C./min for any of samples. The heating temperature and the cooling rate in the high-temperature heat treatment step and the low-temperature heat treatment step were measured by attaching a thermocouple to the R-T-B based sintered magnet material. Furthermore, "–" of samples Nos. 96 and 97 in Table 3 represents the fact that the high-temperature heat treatment step was not performed. The R-T-B based sintered magnet thus obtained after the low-temperature heat treatment step was machined to produce samples of 7 mm in length×7 mm in width×7 mm in thickness, and then $B_r$ and $H_{cJ}$ of each sample were measured by a B—H tracer. The measurements results are shown in Table 3. The results of composition and gas analyses of the R-T-B based sintered magnet whose $B_r$ and $H_{cJ}$ were measured were identical to those of sample No. 34 in Table 1.

TABLE 3

| | High-temperature heat treatment step | | | Low-temperature heat treatment step | | | Magnetic properties | | |
|---|---|---|---|---|---|---|---|---|---|
| No. | Temperature (° C.) | Retention time (Hr) | Cooling rate (° C.)/min | Temperature (° C.) | Retention time (Hr) | Cooling rate (° C.)/min | Br (T) | $H_{cJ}$ (kA/m) | |
| 60 | 1000 | 3 | 27 | 400 | 2 | 20 | 1.370 | 790 | Comparative Example |
| 61 | 1000 | 3 | 27 | 430 | 2 | 22 | 1.360 | 891 | Comparative Example |
| 62 | 1000 | 3 | 27 | 440 | 2 | 21 | 1.348 | 1395 | Present invention |
| 63 | 1000 | 3 | 27 | 480 | 2 | 22 | 1.352 | 1541 | Present invention |
| 64 | 1000 | 3 | 27 | 500 | 2 | 22 | 1.342 | 1541 | Present invention |
| 65 | 1000 | 3 | 27 | 550 | 2 | 21 | 1.340 | 1578 | Present invention |
| 66 | 1000 | 3 | 27 | 560 | 2 | 23 | 1.325 | 1357 | Comparative Example |
| 67 | 900 | 3 | 25 | 430 | 2 | 22 | 1.360 | 1007 | Comparative Example |
| 68 | 900 | 3 | 25 | 480 | 2 | 22 | 1.340 | 1534 | Present invention |
| 69 | 900 | 3 | 25 | 500 | 2 | 22 | 1.340 | 1567 | Present invention |
| 70 | 900 | 3 | 25 | 550 | 2 | 21 | 1.340 | 1537 | Present invention |
| 71 | 900 | 3 | 25 | 560 | 2 | 23 | 1.318 | 1399 | Comparative Example |
| 72 | 800 | 3 | 26 | 430 | 2 | 22 | 1.361 | 971 | Comparative Example |
| 73 | 800 | 3 | 26 | 480 | 2 | 22 | 1.340 | 1531 | Present invention |
| 74 | 800 | 3 | 26 | 500 | 2 | 22 | 1.340 | 1563 | Present invention |
| 75 | 800 | 3 | 26 | 550 | 2 | 21 | 1.340 | 1518 | Present invention |
| 76 | 800 | 3 | 26 | 560 | 2 | 23 | 1.313 | 1392 | Comparative Example |
| 77 | 750 | 3 | 25 | 430 | 2 | 22 | 1.350 | 946 | Comparative Example |
| 78 | 750 | 3 | 25 | 440 | 2 | 21 | 1.350 | 1442 | Present invention |
| 79 | 750 | 3 | 25 | 480 | 2 | 22 | 1.343 | 1491 | Present invention |
| 80 | 750 | 3 | 25 | 500 | 2 | 22 | 1.340 | 1565 | Present invention |
| 81 | 750 | 3 | 25 | 550 | 2 | 21 | 1.340 | 1573 | Present invention |
| 82 | 750 | 3 | 25 | 560 | 2 | 23 | 1.310 | 1300 | Comparative Example |
| 83 | 700 | 3 | 26 | 550 | 2 | 21 | 1.310 | 1371 | Comparative Example |
| 84 | 600 | 3 | 25 | 480 | 2 | 22 | 1.310 | 1304 | Comparative Example |
| 85 | 800 | 6 | 43 | 500 | 3 | 22 | 1.340 | 1568 | Present invention |
| 86 | 750 | 2 | 62 | 480 | 2 | 22 | 1.342 | 1488 | Present invention |
| 87 | 900 | 3 | 3 | 430 | 2 | 22 | 1.356 | 1061 | Comparative Example |
| 88 | 900 | 3 | 3 | 440 | 2 | 21 | 1.359 | 1059 | Comparative Example |
| 89 | 900 | 3 | 3 | 480 | 2 | 22 | 1.361 | 1079 | Comparative Example |
| 90 | 900 | 3 | 3 | 500 | 2 | 22 | 1.358 | 1147 | Comparative Example |
| 91 | 800 | 3 | 3 | 430 | 2 | 21 | 1.350 | 1149 | Comparative Example |
| 92 | 800 | 3 | 3 | 440 | 2 | 22 | 1.350 | 1130 | Comparative Example |

TABLE 3-continued

| | High-temperature heat treatment step | | | Low-temperature heat treatment step | | | Magnetic properties | | |
|---|---|---|---|---|---|---|---|---|---|
| No. | Temperature (° C.) | Retention time (Hr) | Cooling rate (° C.)/min | Temperature (° C.) | Retention time (Hr) | Cooling rate (° C.)/min | Br (T) | $H_{cj}$ (kA/m) | |
| 93 | 800 | 3 | 3 | 480 | 2 | 22 | 1.352 | 1295 | Comparative Example |
| 94 | 800 | 3 | 3 | 500 | 2 | 22 | 1.350 | 1328 | Comparative Example |
| 95 | 800 | 3 | 3 | 560 | 2 | 23 | 1.328 | 1329 | Comparative Example |
| 96 | | — | | 450 | 2 | 21 | 1.330 | 1301 | Comparative Example |
| 97 | | — | | 500 | 2 | 22 | 1.330 | 1311 | Comparative Example |

As shown in Table 3, any of Examples ("present invention" in Table 3), which were subjected to the high-temperature heat treatment step in which the R-T-B based sintered magnet material was heated to a temperature of 730° C. or higher and 1,020° C. or lower and then cooled to 300° C. at a cooling rate of 20° C./min or more, and subjected to the low-temperature heat treatment step in which the R-T-B based sintered magnet material after the high-temperature heat treatment step was heated to a temperature of 440° C. or higher and 550° C. or lower has high magnetic properties of $B_r \geq 1.340$T and $H_{cJ}$ 1,395 A/m. Meanwhile, regarding samples Nos. 60, 61, 66, 67, 71, 72, 76, 77 and 82 for which the temperature in the high-temperature heat treatment step is within the range of the present invention but the temperature in the low-temperature heat treatment step deviates from the range of the present invention, samples Nos. 83 and 84 for which the temperature in the low-temperature heat treatment step is within the range of the present invention but the temperature in the high-temperature heat treatment step deviates from the range of the present invention, samples Nos. 87 to 95 for which the cooling rate in the high-temperature heat treatment step deviates from the range of the present invention, and samples Nos. 96 and 97 for which the high-temperature heat treatment step is not performed, any of the samples does not have high magnetic properties of $B_r \geq 1.340$T and $H_{cJ} \geq 1{,}395$ A/m.

Example 3

An R-T-B based sintered magnet was produced by the same methods as for sample No. 73 in Example 2, except that the cooling rates of the R-T-B based sintered magnet material after heating in the high-temperature heat treatment step of 26° C./min during cooling to 300° C. and 3° C./min during cooling from 300° C. to room temperature were changed to 26° C./min during cooling to 400° C. and 3° C./min during cooling from 400° C. to room temperature. The R-T-B based sintered magnet thus obtained was machined to produce samples of 7 mm in length×7 mm in width×7 mm in thickness, and then $B_r$ and $H_{cJ}$ of each sample were measured by a B—H tracer. The measurements results are shown in sample No. 98 in Table 4. Similarly, an R-T-B based sintered magnet was produced by the same methods as for sample No. 74 in Example 2, except that the cooling rates of the R-T-B based sintered magnet material after heating in the high-temperature heat treatment step of 26° C./min during cooling to 300° C. and 3° C./min during cooling from 300° C. were changed to 26° C./min during cooling to 400° C. and 3° C./min during cooling from 400° C. The R-T-B based sintered magnet thus obtained was machined to produce samples of 7 mm in length×7 mm in width×7 mm in thickness, and then $B_r$ and $H_{cJ}$ of each sample were measured by a B—H tracer. The measurements results are shown in sample No. 99 in Table 4.

TABLE 4

| | Magnetic properties | | |
|---|---|---|---|
| No. | $B_r$ (T) | HcJ (kA/m) | |
| 98 | 1.320 | 1493 | Comparative Example |
| 99 | 1.320 | 1526 | Comparative Example |

As shown in Table 4, since in the high-temperature heat treatment step, the cooling rate of the R-T-B based sintered magnet material after heating is not 20° C./min or more during cooling to 300° C., sample Nos. 98 and 99 do not have high magnetic properties of $B_r \leq 1.340$T and $H_{cJ}$1,395 kA/m, unlike sample Nos. 73 and 74.

Example 4

Nd metal, Pr metal, Dy metal, Tb metal, ferroboron alloy, electrolytic Co, Al metal, Cu metal, Ga metal, ferro-niobium alloy, ferro-zirconium alloy and electrolytic iron (any of metals has a purity of 99% by mass or more) were mixed so as to obtain a given composition, and then a finely pulverized powder (alloy powder) having a grain size $D_{50}$ of 4 μm was obtained in the same manner as in Example 1. By mixing the nitrogen gas with atmospheric air during pulverization, the oxygen concentration in a nitrogen gas during pulverization was adjusted. When mixing with no atmospheric air, the oxygen concentration in the nitrogen gas during pulverization is 50 ppm or less and the oxygen concentration in the nitrogen gas was increased to 1,500 ppm at a maximum by mixing with atmospheric air to produce finely pulverized powders each having a different oxygen amount. The grain size $D_{50}$ is a median size on a volume basis obtained by a laser diffraction method using an air flow dispersion method. In Table 5, O (amount of oxygen), N (amount of nitrogen) and C (amount of carbon) were measured in the same manner as in Example 1.

To the finely pulverized powder, zinc stearate was added as a lubricant in the proportion of 0.05% by mass based on 100% by mass of the finely pulverized powder, followed by mixing to obtain a compact in the same manner as in Example 1. Furthermore, the compact was sintered and subjected to a heat treatment in the same manner as in Example 1. The sintered magnet was subjected to machining after the heat treatment, and then $B_r$ and $H_{cJ}$ of each sample were measured in the same manner as in Example 1. The measurement results are shown in Table 6.

TABLE 5

| | Analysis results of R-T-B-based sintered magnet (% by mass) | | | | | | | | | | | | | | | |
|---|---|---|---|---|---|---|---|---|---|---|---|---|---|---|---|---|
| No. | Nd | Pr | Dy | Tb | B | Co | Al | Cu | Ga | Nb | Zr | Fe | O | N | C | |
| 100 | 23.4 | 7.7 | 0 | 0 | 0.904 | 0.5 | 0.20 | 0.16 | 0.27 | 0.00 | 0.00 | bal. | 0.07 | 0.05 | 0.11 | Present invention |
| 101 | 23.0 | 7.6 | 0 | 0 | 0.910 | 0.5 | 0.20 | 0.12 | 0.27 | 0.00 | 0.00 | bal. | 0.08 | 0.04 | 0.09 | Present invention |
| 102 | 22.7 | 7.4 | 0 | 0 | 0.918 | 0.5 | 0.20 | 0.13 | 0.27 | 0.00 | 0.00 | bal. | 0.13 | 0.03 | 0.08 | Present invention |
| 103 | 22.7 | 7.4 | 0 | 0 | 0.880 | 0.9 | 0.20 | 0.15 | 0.39 | 0.00 | 0.00 | bal. | 0.11 | 0.05 | 0.09 | Present invention |
| 104 | 22.7 | 7.4 | 0 | 0 | 0.892 | 0.9 | 0.20 | 0.15 | 0.39 | 0.00 | 0.00 | bal. | 0.12 | 0.05 | 0.09 | Present invention |
| 105 | 22.7 | 7.4 | 0 | 0 | 0.910 | 0.9 | 0.20 | 0.15 | 0.31 | 0.00 | 0.00 | bal. | 0.15 | 0.05 | 0.11 | Present invention |
| 106 | 22.7 | 7.4 | 0 | 0 | 0.924 | 0.9 | 0.20 | 0.15 | 0.28 | 0.00 | 0.00 | bal. | 0.15 | 0.05 | 0.11 | Present invention |
| 107 | 22.7 | 7.4 | 0 | 0 | 0.890 | 0.5 | 0.20 | 0.15 | 0.35 | 0.00 | 0.00 | bal. | 0.10 | 0.04 | 0.08 | Present invention |
| 108 | 22.7 | 7.4 | 0 | 0 | 0.910 | 0.5 | 0.10 | 0.08 | 0.32 | 0.00 | 0.00 | bal. | 0.10 | 0.05 | 0.10 | Present invention |
| 109 | 22.7 | 7.4 | 0 | 0 | 0.910 | 0.5 | 0.30 | 0.08 | 0.32 | 0.00 | 0.00 | bal. | 0.10 | 0.05 | 0.10 | Present invention |
| 110 | 22.7 | 7.4 | 0 | 0 | 0.910 | 0.5 | 0.50 | 0.08 | 0.32 | 0.00 | 0.00 | bal. | 0.10 | 0.05 | 0.10 | Present invention |
| 111 | 22.7 | 7.4 | 0 | 0 | 0.910 | 0.5 | 0.05 | 0.08 | 0.32 | 0.00 | 0.00 | bal. | 0.10 | 0.05 | 0.10 | Present invention |
| 112 | 22.7 | 7.4 | 0 | 0 | 0.910 | 0.0 | 0.20 | 0.08 | 0.32 | 0.00 | 0.00 | bal. | 0.10 | 0.05 | 0.10 | Present invention |
| 113 | 20.7 | 6.7 | 3.0 | 0 | 0.905 | 0.5 | 0.20 | 0.08 | 0.34 | 0.00 | 0.00 | bal. | 0.10 | 0.05 | 0.10 | Present invention |
| 114 | 22.7 | 7.4 | 0 | 0 | 0.910 | 2.0 | 0.20 | 0.08 | 0.32 | 0.00 | 0.00 | bal. | 0.10 | 0.05 | 0.10 | Present invention |
| 115 | 22.7 | 7.4 | 0 | 0 | 0.910 | 0.5 | 0.20 | 0.08 | 0.32 | 0.10 | 0.00 | bal. | 0.10 | 0.05 | 0.10 | Present invention |
| 116 | 22.7 | 7.4 | 0 | 0 | 0.910 | 0.5 | 0.20 | 0.08 | 0.33 | 0.00 | 0.10 | bal. | 0.10 | 0.05 | 0.10 | Present invention |
| 117 | 22.7 | 7.4 | 0 | 0 | 0.910 | 0.5 | 0.20 | 0.08 | 0.33 | 0.03 | 0.05 | bal. | 0.10 | 0.05 | 0.10 | Present invention |
| 118 | 30.3 | 0.0 | 0 | 0 | 0.910 | 0.5 | 0.20 | 0.08 | 0.33 | 0.00 | 0.00 | bal. | 0.10 | 0.05 | 0.10 | Present invention |
| 119 | 22.7 | 7.4 | 0 | 0 | 0.905 | 0.5 | 0.20 | 0.08 | 0.26 | 0.00 | 0.00 | bal. | 0.10 | 0.05 | 0.10 | Comparative Example |
| 120 | 23.5 | 7.6 | 0 | 0 | 0.888 | 0.5 | 0.20 | 0.15 | 0.31 | 0.00 | 0.00 | bal. | 0.09 | 0.06 | 0.11 | Comparative Example |

TABLE 6

| No. | u | v | w | Region | $B_r$ (T) | $H_{cJ}$ (kA/m) | |
|---|---|---|---|---|---|---|---|
| 100 | 31.1 | 29.33 | 0.904 | 3 | 1.387 | 1451 | Present invention |
| 101 | 30.6 | 29.02 | 0.910 | 3 | 1.374 | 1483 | Present invention |
| 102 | 30.2 | 28.49 | 0.918 | 4 | 1.383 | 1513 | Present invention |
| 103 | 30.2 | 28.29 | 0.880 | 3 | 1.366 | 1602 | Present invention |
| 104 | 30.2 | 28.23 | 0.892 | 3 | 1.370 | 1547 | Present invention |
| 105 | 30.1 | 27.82 | 0.910 | 4 | 1.414 | 1458 | Present invention |
| 106 | 30.2 | 27.89 | 0.924 | 4 | 1.423 | 1442 | Present invention |
| 107 | 30.2 | 28.57 | 0.890 | 3 | 1.371 | 1493 | Present invention |
| 108 | 30.2 | 28.27 | 0.910 | 4 | 1.401 | 1505 | Present invention |
| 109 | 30.2 | 28.27 | 0.910 | 4 | 1.387 | 1545 | Present invention |
| 110 | 30.2 | 28.27 | 0.910 | 4 | 1.373 | 1585 | Present invention |
| 111 | 30.2 | 28.27 | 0.910 | 4 | 1.406 | 1495 | Present invention |
| 112 | 30.2 | 28.27 | 0.910 | 4 | 1.393 | 1533 | Present invention |
| 113 | 30.4 | 28.50 | 0.905 | 3 | 1.326 | 2001 | Present invention |
| 114 | 30.2 | 28.27 | 0.910 | 4 | 1.399 | 1523 | Present invention |
| 115 | 30.2 | 28.27 | 0.910 | 4 | 1.402 | 1517 | Present invention |
| 116 | 30.2 | 28.27 | 0.910 | 4 | 1.403 | 1506 | Present invention |
| 117 | 30.2 | 28.27 | 0.910 | 4 | 1.404 | 1513 | Present invention |
| 118 | 30.3 | 28.40 | 0.910 | 4 | 1.415 | 1433 | Present invention |
| 119 | 30.1 | 28.20 | 0.905 | 4 | 1.394 | 1300 | Comparative Example |
| 120 | 31.1 | 29.08 | 0.888 | x | 1.388 | 1280 | Comparative Example |

u in Table 6 is the value obtained by summing up the amounts (% by mass) of Nd, Pr, Dy and Tb in Table 5, and v is the value obtained by subtracting $6\alpha+10\beta+8\gamma$, where the amount of oxygen (% by mass) is $\alpha$, the amount of nitrogen (% by mass) is $\beta$, and the amount of carbon (% by mass) is $\gamma$ in Table 5, from u. Regarding w, the amount of B in Table 5 was transferred as it is. The region in Table 6 indicates the position of v and w in FIG. 2. The column in the table was filled with "3" when v and w exist in the region 3 in FIG. 2, while the column in the table was filled with "4" when v and w exist in the region 4 in FIG. 3. Furthermore, when v and w exist in the region except for the regions 3 and 4 in FIG. 2, the column in the table was filled with the mark "x".

As shown in Table 6, when Dy and Tb are not included in the raw material alloy, and $0.20 \leq x(Ga) < 0.40$, any of example samples (example samples except for sample No. 113), which exhibits the relationship between v and w located in the region of the present invention (regions 3 and 4 in FIG. 2), and also satisfies the following inequality expressions: $-(62.5w+v-81.625)/15+0.5 \leq x-(62.5w+v-81.625)/15+0.8$, $0.07 \leq y$ (Cu) 0.2, $0.05 \leq z$ (Al) $\leq 0.5$, and $0 \leq q$ (Nb and/or Zr) $\leq 0.1$, exhibits $B_r \geq 1.366$T and $H_{cJ} \geq 1{,}433$ kA/m, and also has high magnetic properties, which are identical to or higher than those of example sample of Example 1, regardless of the amount of Ga smaller than that of example sample of Example 1 (x (Ga) of 0.40% by mass or more). Meanwhile, regarding comparative example samples No. 120 in which the amounts of Ga, Cu, and Al are within the range of the present invention but v and w deviate from the range of the present invention (region except for the region 3 or 4 in FIG. 2) and comparative example sample No. 119 in which v and w are within the range of the present invention (region 3 or 4 in FIG. 2) but the amount of Ga deviates from the range of the present invention, high magnetic properties of $B_r \geq 1.366$T and $H_{cJ} \geq 1{,}433$ kA/m are not obtained.

Example 5

Nd metal, Pr metal, ferroboron alloy, electrolytic Co, Al metal, Cu metal, Ga metal and electrolytic iron (any of metals has a purity of 99% by mass or more) were mixed so as to obtain the same composition as that of sample No. 105 in Example 4, and then these raw materials were melted and subjected to casting by the same methods as in Example 1 to obtain a raw material alloy. The raw material alloy thus obtained was subjected to hydrogen treatment and dry pulverization by the same methods as in Example 1 to obtain a finely pulverized powder. Furthermore, compacting and sintering were performed by the same methods as in Example 1 to obtain an R-T-B based sintered magnet material. The R-T-B based sintered magnet material had a density of 7.5 $Mg/m^3$ or more. The results of composition and gas analyses of the R-T-B based sintered magnet material thus obtained were identical to those of sample No. 105 in Example 4.

The R-T-B based sintered magnet material thus obtained was subjected to a high-temperature heat treatment step under the conditions shown in Table 7, and the R-T-B based sintered magnet material after the high-temperature heat treatment step was subjected to a low-temperature heat treatment step under the conditions shown in Table 7. In Table 7, temperatures (° C.) in the high-temperature heat treatment step and the low-temperature heat treatment step are the heating temperatures of the R-T-B based sintered magnet material, and retention times (Hr) are the retention times at the heating temperature. Cooling rate (° C./min) represents an average cooling rate during cooling from the temperature at which the R-T-B based sintered magnet material was retained after the elapse of the retention time to 300° C. The cooling rates during cooling from 300° C. to room temperature in the high-temperature heat treatment step and the low-temperature heat treatment step were 3° C./min for any of samples. A variation in average cooling rate (from the retained temperature to 300° C., and from 300° C. to room temperature) (difference between the maximum value and the minimum value of the cooling rate) was within 3° C./min for any of samples. The heating temperature and the cooling rate in the high-temperature heat treatment step and the low-temperature heat treatment step were measured by attaching a thermocouple to the R-T-B based sintered magnet material. Furthermore, "–" of samples Nos. 165 and 166 in Table 7 represents the fact that the high-temperature heat treatment step was not performed. The R-T-B based sintered magnet thus obtained after the low-temperature heat treatment step was machined to produce samples of 7 mm in length×7 mm in width×7 mm in thickness, and then $B_r$ and $H_{cJ}$ of each sample were measured by a B—H tracer. The measurements results are shown in Table 7. The results of composition and gas analyses of the R-T-B based sintered magnet whose $B_r$ and $H_{cJ}$ were measured were identical to those of sample No. 105 in Table 5.

TABLE 7

| | High-temperature heat treatment step | | | Low-temperature heat treatment step | | | Magnetic properties | | |
|---|---|---|---|---|---|---|---|---|---|
| No. | Temperature (° C.) | Retention time (Hr) | Cooling rate (° C.)/min | Temperature (° C.) | Retention time (Hr) | Cooling rate (° C.)/min | Br (T) | $H_{cJ}$ (kA/m) | |
| 130 | 1000 | 3 | 21 | 400 | 2 | 21 | 1.444 | 685 | Comparative Example |
| 131 | 1000 | 3 | 21 | 430 | 2 | 23 | 1.434 | 786 | Comparative Example |
| 132 | 1000 | 3 | 21 | 480 | 2 | 21 | 1.426 | 1436 | Present invention |
| 133 | 1000 | 3 | 21 | 500 | 2 | 22 | 1.416 | 1436 | Present invention |
| 134 | 1000 | 3 | 21 | 550 | 2 | 20 | 1.414 | 1473 | Present invention |
| 135 | 1000 | 3 | 22 | 560 | 2 | 24 | 1.399 | 1252 | Comparative Example |
| 136 | 900 | 3 | 24 | 430 | 2 | 23 | 1.434 | 902 | Comparative Example |
| 137 | 900 | 3 | 24 | 480 | 2 | 21 | 1.414 | 1429 | Present invention |
| 138 | 900 | 3 | 24 | 500 | 2 | 22 | 1.414 | 1462 | Present invention |
| 139 | 900 | 3 | 24 | 550 | 2 | 20 | 1.414 | 1432 | Present invention |
| 140 | 900 | 3 | 24 | 560 | 2 | 24 | 1.392 | 1294 | Comparative Example |
| 141 | 800 | 3 | 23 | 430 | 2 | 23 | 1.435 | 866 | Comparative Example |
| 142 | 800 | 3 | 23 | 480 | 2 | 21 | 1.414 | 1426 | Present invention |
| 143 | 800 | 3 | 23 | 500 | 2 | 22 | 1.414 | 1458 | Present invention |
| 144 | 800 | 3 | 23 | 550 | 2 | 20 | 1.414 | 1413 | Present invention |
| 145 | 800 | 3 | 23 | 560 | 2 | 24 | 1.387 | 1287 | Comparative Example |
| 146 | 750 | 3 | 21 | 430 | 2 | 23 | 1.424 | 841 | Comparative Example |
| 147 | 750 | 3 | 24 | 450 | 2 | 21 | 1.424 | 1373 | Present invention |
| 148 | 750 | 3 | 24 | 480 | 2 | 21 | 1.417 | 1386 | Present invention |
| 149 | 750 | 3 | 24 | 500 | 2 | 22 | 1.414 | 1460 | Present invention |
| 150 | 750 | 3 | 24 | 550 | 2 | 20 | 1.414 | 1468 | Present invention |
| 151 | 750 | 3 | 21 | 560 | 2 | 24 | 1.384 | 1195 | Comparative Example |
| 152 | 700 | 3 | 23 | 550 | 2 | 20 | 1.384 | 1266 | Comparative Example |
| 153 | 600 | 3 | 22 | 480 | 2 | 21 | 1.384 | 1199 | Comparative Example |
| 154 | 800 | 6 | 40 | 500 | 3 | 22 | 1.414 | 1463 | Present invention |
| 155 | 750 | 2 | 63 | 480 | 2 | 21 | 1.416 | 1383 | Present invention |
| 156 | 900 | 3 | 3 | 430 | 2 | 23 | 1.430 | 956 | Comparative Example |
| 157 | 900 | 3 | 3 | 440 | 2 | 22 | 1.433 | 954 | Comparative Example |
| 158 | 900 | 3 | 3 | 480 | 2 | 21 | 1.435 | 974 | Comparative Example |
| 159 | 900 | 3 | 3 | 500 | 2 | 22 | 1.432 | 1042 | Comparative Example |
| 160 | 800 | 3 | 3 | 430 | 2 | 23 | 1.424 | 1044 | Comparative Example |
| 161 | 800 | 3 | 3 | 440 | 2 | 22 | 1.424 | 1025 | Comparative Example |
| 162 | 800 | 3 | 3 | 480 | 2 | 21 | 1.426 | 1190 | Comparative Example |
| 163 | 800 | 3 | 3 | 500 | 2 | 22 | 1.424 | 1223 | Comparative Example |
| 164 | 800 | 3 | 3 | 560 | 2 | 24 | 1.402 | 1224 | Comparative Example |
| 165 | — | | — | 450 | 2 | 21 | 1.404 | 1196 | Comparative Example |
| 166 | — | | — | 500 | 2 | 22 | 1.404 | 1206 | Comparative Example |

As shown in Table 7, any of Examples (present invention in Table 7), which were subjected to the high-temperature heat treatment step in which the R-T-B based sintered magnet material was heated to a temperature of 730° C. or higher and 1,020° C. or lower and then cooled to 300° C. at a cooling rate of 20° C./min or more, and subjected to the low-temperature heat treatment step in which the R-T-B based sintered magnet material after the high-temperature heat treatment step was heated to a temperature of 440° C. or higher and 550° C. or lower has high magnetic properties of $B_r \geq 1.414T$ and $H_{cJ} \geq 1{,}373$ kA/m. Meanwhile, regarding samples Nos. 130, 131, 135, 136, 140, 141, 145, 146 and 151 for which the temperature in the high-temperature heat treatment step is within the range of the present invention but the temperature in the low-temperature heat treatment step deviates from the range of the present invention, samples Nos. 152 and 153 for which the temperature in the low-temperature heat treatment step is within the range of the present invention but the temperature in the high-temperature heat treatment step deviates from the range of the present invention, samples Nos. 156 to 164 for which the cooling rate in the high-temperature heat treatment step deviates from the range of the present invention, and samples Nos. 165 and 166 for which the high-temperature heat treatment step is not performed, any of the samples does not have high magnetic properties of $B_r \geq 1.414T$ and $H_{cJ} \geq 1,373$ kA/m.

Priority is claimed on Japanese Patent Application No. 2013-180951, filed on Sep. 2, 2013, and Japanese Patent Application No. 2014-061623, filed on Mar. 25, 2014, as a basic application. The entire disclosures of Japanese Patent Application Nos. 2013-180951 and 2014-061623 are hereby incorporated herein by reference.

INDUSTRIAL APPLICABILITY

The R-T-B-based sintered magnet according to the present invention can be suitably employed in many uses including motors for hybrid cars and electric cars.

The invention claimed is:

1. A method for producing an R-T-B based sintered magnet comprising:

a step of preparing an R-T-B based sintered magnet material, which is represented by the following formula (1):

$$uRwBxGayCuzAlqM(100\text{-}u\text{-}w\text{-}x\text{-}y\text{-}z\text{-}q)T \quad (1)$$

where

R is composed of light rare-earth element(s) RL and a heavy rare-earth element(s) RH, RL is Nd and/or Pr, RH is at least one of Dy, Tb, Gd and Ho, T is a transition metal element and includes Fe, M is Nb and/or Zr, and u, w, x, y, z, q, and 100-u-w-x-y-z-q are expressed in terms of % by mass;

the RH accounts for 5% by mass or less of the R-T-B based sintered magnet, the following inequality expressions (2) to (5) and (12) being satisfied:

$$0.20 \leq x \leq 0.70 \quad (2)$$

$$0.07 \leq y \leq 0.2 \quad (3)$$

$$0.05 \leq z \leq 0.5 \quad (4)$$

$$0 \leq q \leq \mathbf{0.1} \quad (5)$$

$$0.844 \leq w \leq 0.93 \quad (13)$$

$v = u - (6\alpha + 10\beta + 8\gamma)$, where the amount of oxygen (% by mass) of the R-T-B based sintered magnet is $\alpha$, the amount of nitrogen (% by mass) is $\beta$, and the amount of carbon (% by mass) is $\gamma$;

when $0.40 \leq x \leq 0.70$, v and w satisfy the following inequality expressions (6) and (7):

$$50w - 18.5 \leq v \leq 50w - 14 \quad (6)$$

$$-12.5w + 38.75 \leq v \leq -62.5w + 86.125 \quad (7)$$

and, when $0.20 \leq x \leq 0.40$, v and w satisfy the following inequality expressions (8) and (9), and x satisfies the following inequality expression (10):

$$50w - 18.5 \leq v \leq 50w - 15.5 \quad (8)$$

$$-12.5w + 39.125 \leq v \leq -62.5w + 86.125 \quad (9)$$

$$-(62.5w + v - 81.625)/15 + 0.5x \leq x - (62.5w + v - 81.625)/15 + 0.8 \quad (10).$$

wherein in the step of preparing the R-T-B based sintered magnet material , R-T-B based sintered magnet material is obtained by sintering;

a high-temperature heat treatment step of heating the R-T-B based sintered magnet material to a temperature of 730° C. or higher and 1,020° C. or lower, and then cooling to 300° C. at a cooling rate of 25° C./min or more; and a low-temperature heat treatment step of heating the R-T-B based sintered magnet material, after the high-temperature heat treatment step, to a temperature of 440° C. or higher and 550° C. or lower;

wherein $H_{cJ}$ of the R-T-B based sintered magnet satisfies the following expression:

$H_{cJ}$ (kA/m) $\geq 1,360 + 160$ [Dy]+240[Tb], where the amount of Dy (% by mass) is [Dy]) and the amount of Tb (% by mass) is [Tb]).

2. The method for producing an R-T-B based sintered magnet according to claim 1, wherein the low-temperature heat treatment step is a step of heating to a temperature of 480° C. or higher and 550° C. or lower.

3. The method for producing an R-T-B based sintered magnet according to claim 2, wherein the amount of oxygen of the R-T-B based sintered magnet obtained is 0.15% by mass or less.

4. The method for producing an R-T-B based sintered magnet according to claim 1, wherein the amount of oxygen of the R-T-B based sintered magnet obtained is 0.15% by mass or less.

5. The method for producing an R-T-B based sintered magnet according to claim 1, wherein, when $0.40 \leq x \leq 0.70$, v and w satisfy the following inequality expressions (11) and (7):

$$50w - 18.5 \leq v \leq 50w - 16.25 \quad (11)$$

$$-12.5w + 38.75 \leq v \leq -62.5w + 86.125 \quad (7)$$

and, when $0.20 \leq x \leq 0.40$, v and w satisfy the following inequality expressions (12) and (9), and x satisfies the following inequality expression (10):

$$50w - 18.5 \leq v \leq 50w - 17.0 \quad (12)$$

$$-12.5w + 39.125 \leq v \leq -62.5w + 86.125 \quad (9)$$

$$-(62.5w + v - 81.625)/15 + 0.5x \leq -(62.5w + v - 81.625)/15 + 0.8 \quad (10).$$

6. The method for producing an R-T-B based sintered magnet according to claim 5, wherein the low-temperature heat treatment step is a step of heating to a temperature of 480° C. or higher and 550° C. or lower.

7. The method for producing an R-T-B based sintered magnet according to claim 6, wherein the amount of oxygen of the R-T-B based sintered magnet obtained is 0.15% by mass or less.

8. The method for producing an R-T-B based sintered magnet according to claim 5, wherein the amount of oxygen of the R-T-B based sintered magnet obtained is 0.15% by mass or less.

9. The method for producing an R-T-B based sintered magnet according to claim 1, wherein $B_r$ of the R-T-B based sintered magnet satisfies the following expression:

$$B_r\ (T) \geq 1.340 - 0.024[Dy] - 0.024[Tb].$$

10. A method for producing an R-T-B based sintered magnet comprising:

a step of preparing an R-T-B based sintered magnet material, which is represented by the following formula (1):

$$uRwBxGayCuzAlqM(100\text{-}u\text{-}w\text{-}x\text{-}y\text{-}z\text{-}q)T \quad (1)$$

where

R is composed of light rare-earth element(s) RL and a heavy rare-earth element(s) RH, RL is Nd and/or Pr, RH is at least one of Dy, Tb, Gd and Ho, T is a transition metal element and includes Fe, M is Nb and/or Zr, and u, w, x, y, z, q, and 100-u-w-x-y-z-q are expressed in terms of % by mass;

the RH accounts for 5% by mass or less of the R-T-B based sintered magnet, the following inequality expressions (2) to (5) and (13) being satisfied:

$$0.20 \le x \le 0.70 \quad (2)$$

$$0.07 \le y \le 0.2 \quad (3)$$

$$0.05 \le z \le 0.5 \quad (4)$$

$$0 \le q \le \mathbf{0.1} \quad (5)$$

$$0.844 \le w \le 0.910 \quad (13)$$

$v = u - (6\alpha + 10\beta + 8\gamma)$, where the amount of oxygen (% by mass) of the R-T-B based sintered magnet is $\alpha$, the amount of nitrogen (% by mass) is $\beta$, and the amount of carbon (% by mass) is $\gamma$;

when $0.40 \le x \le 0.70$, v and w satisfy the following inequality expressions (6) and (7):

$$50w - 18.5 \le v \le 50w - 14 \quad (6)$$

$$-12.5w + 38.75 \le v \le -62.5w + 86.125 \quad (7)$$

and, when $0.20 \le x \le 0.40$, v and w satisfy the following inequality expressions (8) and (9), and x satisfies the following inequality expression (10):

$$50w - 18.5 \le v \le 50w - 15.5 \quad (8)$$

$$-12.5w + 39.125 \le v \le -62.5w + 86.125 \quad (9)$$

$$-(62.5w + v - 81.625)/15 + 0.5x \le x - (62.5w + v - 81.625)/15 + 0.8 \quad (10).$$

wherein in the step of preparing the R-T-B based sintered magnet material , R-T-B based sintered magnet material is obtained by sintering; p1 a high-temperature heat treatment step of heating the R-T-B based sintered magnet material to a temperature of 730° C. or higher and 1,020° C. or lower, and then cooling to 300° C. at a cooling rate of 25° C./min or more; and a low-temperature heat treatment step of heating the R-T-B based sintered magnet material, after the high-temperature heat treatment step, to a temperature of 440° C. or higher and 550° C. or lower.

11. The method for producing an R-T-B based sintered magnet according to claim 10, wherein $H_{cj}$ and $B_r$ of the R-T-B based sintered magnet satisfy the following expressions:

$H_{cj}$ (kA/m) ≥1,360 +160 [Dy]+240[Tb],and $B_r$ (T) ≥1.340−0.024[Dy]−0.024[Tb], where the amount of Dy (% by mass) is [Dy] and the amount of Tb (% by mass) is [Tb].

12. A method for producing an R-T-B based sintered magnet comprising:

a step of preparing an R-T-B based sintered magnet material, which is represented by the following formula (1):

$$uRwBxGayCuzAlqM(100-u-w-x-y-z-q)T \quad (1)$$

where

R is composed of light rare-earth element(s) RL and a heavy rare-earth element(s) RH, RL is Nd and/or Pr, RH is at least one of Dy, Tb, Gd and Ho, T is a transition metal element and includes Fe, M is Nb and/or Zr, and u, w, x, y, z, q, and 100-u-w-x-y-z-q are expressed in terms of % by mass;

the RH accounts for 5% by mass or less of the R-T-B based sintered magnet, the following inequality expressions (2) to (5) and (13) being satisfied:

$$0.40 \le x \le 0.70 \quad (2)$$

$$0.07 \le y \le 0.2 \quad (3)$$

$$0.05 \le z \le 0.5 \quad (4)$$

$$0 \le q \le \mathbf{0.1} \quad (5)$$

$$0.844 \le w \le 0.93 \quad (13)$$

$v = u - (6\alpha + 10\beta + 8\gamma)$, where the amount of oxygen (% by mass) of the R-T-B based sintered magnet is $\alpha$, the amount of nitrogen (% by mass) is $\beta$, and the amount of carbon (% by mass) is $\gamma$;

v and w satisfy the following inequality expressions (6) and (7):

$$50w - 18.5 \le v \le 50w - 14 \quad (6)$$

$$-12.5w + 38.75 \le v \le -62.5w + 86.125 \quad (7)$$

wherein in the step of preparing the R-T-B based sintered magnet material , R-T-B based sintered magnet material is obtained by sintering;

a high-temperature heat treatment step of heating the R-T-B based sintered magnet material to a temperature of 730° C. or higher and 1,020° C. or lower, and then cooling to 300° C. at a cooling rate of 25° C./min or more; and a low-temperature heat treatment step of heating the R-T-B based sintered magnet material, after the high-temperature heat treatment step, to a temperature of 440° C. or higher and 550° C. or lower.

* * * * *